US006909414B2

(12) United States Patent
Tsuchi et al.

(10) Patent No.: US 6,909,414 B2
(45) Date of Patent: Jun. 21, 2005

(54) DRIVER CIRCUIT AND LIQUID CRYSTAL DISPLAY DEVICE

(75) Inventors: Hiroshi Tsuchi, Tokyo (JP); Yoshinori Uchiyama, Kanagawa (JP)

(73) Assignee: NEC Corporation, Tokyo (JP)

( * ) Notice: Subject to any disclaimer, the term of this patent is extended or adjusted under 35 U.S.C. 154(b) by 335 days.

(21) Appl. No.: 10/188,962

(22) Filed: Jul. 5, 2002

(65) Prior Publication Data

US 2003/0006979 A1 Jan. 9, 2003

(30) Foreign Application Priority Data

Jul. 6, 2001 (JP) ..... 2001-206987

(51) Int. Cl.[7] ..... G09G 3/36
(52) U.S. Cl. ..... 345/89; 345/690
(58) Field of Search ..... 345/204–211, 87–104, 345/690–693; G09G 3/36, 3/20

(56) References Cited

U.S. PATENT DOCUMENTS 5,694,225 A * 12/1997 Suzuki ..... 358/461
6,567,066 B1 * 5/2003 Hashimoto ..... 345/100

FOREIGN PATENT DOCUMENTS

JP 2000-338461 12/2000

OTHER PUBLICATIONS

"A New Low–Power Driver for Portable Devices," by H. Tsuchi, N. Ikeda and H. Hayama, SID 00 DIGEST pp. 146–149.

* cited by examiner

*Primary Examiner*—Alexander Eisen
(74) *Attorney, Agent, or Firm*—McGinn & Gibb, PLLC

(57) ABSTRACT

Disclosed is a driver circuit, as well as a LCD device having the driver circuit, in which changeover between first and second buffer circuits the operating ranges of which extend to high- and low-potential power supply voltages can be performed reliably within the drive changeover range. The driver circuit includes first and second buffer circuits having their input terminals connected in common with one input terminal to which an input signal voltage is input and having their output terminals connected in common with an output terminal, the first and second buffer circuits having operating ranges that extend to high- and low-potential power supply voltages, respectively; first and second storage units for storing respectively positive- and negative-polarity reference data, which correspond to voltages within a range in which both of the first and second buffer circuits are operable, with regard to each of a standard state and modulated state of a gamma characteristic; a selector for selecting either of the storage units based upon a polarity signal, and selectively outputting reference data corresponding to the standard or modulated state based upon modulation information that specifies modulation; and a comparator for comparing entered data and the reference data output from the selector. Activation and deactivation of the first and second buffer circuits is controlled based upon an output signal from the comparator and a control signal.

66 Claims, 25 Drawing Sheets

FIG . 2

| CONTROL SIGNAL | L | H | H |
|---|---|---|---|
| OUTPUT (PN) OF COMPARATOR 5 | L OR H | H | L |
| FIRST ANALOG BUFFER | DEACTIVATE | ACTIVATE | DEACTIVATE |
| SECOND ANALOG BUFFER | DEACTIVATE | DEACTIVATE | ACTIVATE |

LIQUID CRYSTAL GAMMA CHARACTERISTIC AND DRIVER-CIRCUIT OPERATING RANGE (STANDARD STATE) INCOMMON INVERSION DRIVE

CIRCUIT OPERATING RANGE (GAMMA-MODULATED STATE) IN COMMON INVERSION DRIVE

FIG . 8

| CONTROL SIGNAL | L | H | H |
|---|---|---|---|
| OUTPUT OF COMPARATOR 12 | L OR H | H | L |
| FIRST ANALOG BUFFER | DEACTIVATE | ACTIVATE | DEACTIVATE |
| SECOND ANALOG BUFFER | DEACTIVATE | DEACTIVATE | ACTIVATE |

※ C1, C2: PARASITIC CAPACITANCE MALFUNCTION CAN BE PREVENTED BY DESIGNING CIRCUITRY SUCH THAT C2>C1 WILL HOLD

※ C1, C2: PARASITIC CAPACITANCE MALFUNCTION CAN BE PREVENTED BY DESIGNING CIRCUITRY SUCH THAT C2>C1 WILL HOLD

| SC0 | L | H | H |
|---|---|---|---|
| VO | L OR H | H | L |
| OUTPUT OF NAND GATE 22 | H | L | H |
| OUTPUT OF NAND GATE 23 | H | H | L |

DRIVER CIRCUIT AND LIQUID CRYSTAL DISPLAY DEVICE

FIELD OF THE INVENTION

This invention relates to a driver circuit and, more particularly, to a driver circuit suited for driving a capacitative load.

BACKGROUND OF THE INVENTION

For technical publications related to the present invention, see (1) the reference "A New Low-Power Driver for Portable Devices," by H. Tsuchi, N. Ikeda and H. Hayama, SID 00 DIGEST pp. 146–149, and (2) the specification of Japanese Patent Kokai Publication JP-A-2000-33846.

FIG. 24 is a diagram illustrating one example of a driver circuit for driving video digital data in a liquid crystal display device [see FIG. 1 in reference (1)].

The buffer shown in FIG. 24 is such that even if a full-range output cannot be produced with an analog buffer alone, a full-range output is made possible by switching between two analog buffer circuits (referred to simply as "buffer circuits" below) The term "full-range output" refers to substantially the entire area of the range of power supply voltage of the driver circuit As shown in FIG. 24, a first buffer circuit 1010 comprises a first changeover switch 1041 having a stationary end, which is connected to an input terminal 1001, and first and second switching terminals; a first constant-current source 1013 connected serially between the first switching terminal of the first changeover switch 1041 and a high-potential power supply VDD; a P-channel MOS transistor 1011 having a source, which is connected to the first terminal of the first changeover switch 1041, and a gate and drain that are tied together; a second constant-current source 1014 connected between the drain of the P-channel MOS transistor 1011 and a low-potential power supply VSS; a second changeover switch 1042 having a stationary end, which is connected to an output terminal 1002, and first and second switching terminals; a third constant-current source 1015 connected serially between the first switching terminal of the second changeover switch 1042 and the high-potential power supply VDD; and a P-channel MOS transistor 1012 having a source connected to the first terminal of the second changeover switch 1042, a gate connected to the gate of the P-channel MOS transistor 1011, and a drain connected to the low-potential power supply VSS.

A second buffer circuit 1020 comprises a fourth constant-current source 1023 connected between the low-potential power supply VSS and the second switching terminal of the first changeover switch 1041 whose fixed end is connected to the input terminal 1001; an N-channel MOS transistor 1021 having a source, which is connected to the second terminal of the first changeover switch 1041, and a gate and drain that are tied together; a fifth constant-current source 1024 connected between the drain of the N-channel MOS transistor 1021 and the high-potential power supply VDD; a sixth constant-current source 1025 connected serially between the low-potential power supply VSS and the second switching terminal of the second changeover switch 1042 whose stationary end is connected to the output terminal 1002; and an N-channel MOS transistor 1022 having a source connected to the second terminal of the second changeover switch 1042, a gate connected to the gate of the N-channel MOS transistor 1021, and a drain connected to the high-potential power supply VDD.

The buffer further includes a precharging circuit 1030, which comprises a switch 1031 between the output terminal 1002 and the high-potential power supply VDD, and a switch 1032 between the output terminal 1002 and the low-potential power supply VSS, for pre-discharging and precharging, the output terminal 1002.

FIG. 25 illustrates the structure of a 6-bit digital-data driver [see FIG. 3 in reference (1)]. The driver comprises a shift register 1100, a data register 1110, a latch 1120, a level shifter circuit 1130, an R-DAC 1160 (a reference-voltage generator 1150 and ROM decoder 1140), and the new buffer 1170. Analog voltage is supplied from the ROM decoder 1140 to the new buffer 1170, 1-bit data (D00, D10 and D20) of each 6-bit data set of R, G, B is supplied from the ROM decoder 1140 to the new buffer 1170, the precharging circuit 1030 supplies the data line with a suitable power supply voltage (VDD, VSS) based upon the single bit of data, and the switches 1041 and 1042 are selected to select the buffer circuit 1010 or 1020.

If the driver circuit shown in FIG. 24 is applied to a common-inversion drive liquid crystal display circuit (drive in which opposing-electrode voltage Vcom is inverted), little power is consumed, Such a driver circuit is ideal for driving the liquid crystal display device of a mobile terminal such as a cellular telephone terminal. Further, by using a driver circuit that produces a full-range output, power consumption can be reduced further by lowering the power supply voltage. The driver circuit of FIG. 24 is one which can produce a full-range output by switching between the first buffer circuit 1010 and second buffer circuit 1020.

The first buffer circuit 1010 and second buffer circuit 1020 have a limitation imposed upon their operating ranges owing to the threshold voltage Vth of their transistors. The changeover between the first buffer circuit 1010 and second buffer circuit 1020 must be performed in a voltage range (Vlim1 to Vlim2) in which both of these buffer circuits operate.

If conditions such as ambient temperature are fixed, switching between the first buffer circuit 1010 and second buffer circuit 1020 in accordance with video digital data can perform driving.

In order to facilitate an understanding of the present invention, changeover between the buffer circuits 1010 and 1020 in a case where the driver circuit shown in FIG. 24 is used to drive the data line of a liquid crystal display panel will be described with reference to FIG. 6

FIG. 6A is a diagram useful in describing a liquid crystal gamma characteristic (grayscale and signal voltage) and driver-circuit operating range (in the standard state) in common inversion drive (where potential Vcom of opposing electrodes of a liquid crystal display device is switched between a high-potential voltage source and a low-potential voltage source). In FIG. 6A and in similar diagrams below, it will be assumed that the grayscale level has one-to-one correspondence with video digital data and that each grayscale is associated with two analog voltages corresponding to polarity. FIG. 6B is a diagram useful in describing a liquid crystal gamma characteristic and driver-circuit operating range (at the time of gamma modulation) in common inversion drive.

The operating range of a first analog buffer (which corresponds to the first buffer circuit 1010 of FIG. 24) is a voltage of 2 to 5V (which corresponds to grayscale 24 to 63 in positive polarity and grayscale 0 to 56 in negative polarity), the operating range of a second analog buffer (which corresponds to the second buffer circuit 1020 of FIG.

24) is a voltage of 0 to 3V (which corresponds to grayscale 0 to 56 in positive polarity and grayscale 24 to 63 in negative polarity ), and the range in which drive changeover is possible is a voltage of 2 to 3V Even if operation of the first and second analog buffers is changed over at level 32 using one higher-order bit of video digital data, for example, the voltage at changeover (the input voltage corresponding to the video digital data) for each of the positive and negative polarities is within the range in which the first and second analog buffers are capable of operating. As a result, an analog voltage corresponding to the grayscale level can be output.

Accordingly, in the case of the liquid crystal gamma characteristic (grayscale and voltage characteristic) of the kind shown in FIG. 6A, the first and second analog buffers can be changed over at grayscale level 32 by one higher-order bit of video digital data.

However, in the case of a gamma characteristic of the kind shown in FIG. 6B, the voltage of grayscale level 32 in the characteristic (solid line) of positive polarity is outside the operating range of the first analog buffer (which corresponds to the first buffer circuit 1010 of FIG. 24), and the voltage of grayscale level 32 in the characteristic (dashed line) of negative polarity is outside the operating range of the second analog buffer (which corresponds to the second buffer circuit 1020 of FIG. 24). This means that a changeover can no longer be performed at level 32. In other words, if the operating range of a first analog buffer is a voltage of 2 to 5V (grayscale levels 24 to 63), the operating range of a second analog buffer is a voltage of 0 to 3V (grayscale levels 24 to 63) and the first and second buffers are changed over at level 32, then the output of the first analog buffer will be fixed to voltage Vlim1 between levels 32 to 48 with regard to positive polarity and the output of the second analog buffer will be fixed to voltage Vlim2 between levels 32 to 48 with regard to negative polarity. That is, even if a video digital signal corresponding to grayscale levels 32 to 48 is input between grayscale levels 32 to 48, an analog voltage corresponding to these levels will not be output and so-called a skip in grayscale levels occurs. It should be noted that FIG. 6B illustrates an example of a case where modulation of the gamma characteristic is approximately the same for both the positive and negative polarities. However, it is readily understood that modulation that differs depending upon polarity also may occur.

In order to support operation under a wide range of temperatures as in the case of a mobile terminal or the like, various types of modulation are required. For example, display quality is maintained by modulating the gamma characteristic with respect to temperature, and power consumption is suppressed by modulating power supply voltage. A problem that arises in such cases is that a fixed changeover between buffers conforming to some specific video digital data(some specific grayscale level) cannot be carried out.

SUMMARY OF THE DISCLOSURE

Accordingly, it is an object of the present invention to provide a driver circuit so adapted that a first buffer circuit, which has an operating range at least on the side of a high potential, and a second buffer circuit, which has an operating range at least on the side of a low potential, can be switched between reliably in a drive changeover range, as well as a liquid crystal display device having this driver circuit.

In accordance with one aspect of the present invention, the above and other objects are attained by providing a driver circuit for driving an output load, comprising: first and second buffer circuits having respective ones of input terminals connected in common with one input terminal provided for receiving an input signal voltage and respective ones of output terminals connected in common with an output terminal, said first buffer circuit having an operating range at least on the side of a high potential and said second buffer circuit having an operating range at least on the side of a low potential; a storage unit for storing reference data, which is for selecting changeover between operation of said first buffer circuit and operation of said second buffer circuit, the reference data corresponding to a voltage that is in a changeover range in which both the first and second buffer circuits are capable of operating; a comparator for comparing an entered data signal and the reference data; and means for controlling switching of said first buffer circuit and said second buffer circuit between activation and deactivation thereof within a range in which both of said buffer circuits are capable of operating, based upon an output signal of said comparator, which indicates result of the comparison, and a control signal.

A driver circuit, in accordance with another aspect of the present invention, comprises: first and second buffer circuits having respective ones of input terminals connected commonly to one input terminal provided for receiving an input signal voltage and respective ones of output terminals connected commonly to an output terminal, the first buffer circuit having an operating range that extends to a high-potential power supply voltage and the second buffer circuit having an operating range that extends to a low-potential power supply voltage; a storage unit for storing, in association with a relationship between entered digital data and signal voltage, reference data, which is for determining changeover between the first buffer circuit and the second buffer circuit, with regard to positive polarity defining a characteristic from the low-potential power supply voltage and negative polarity defining a characteristic from the high-potential power supply voltage, the reference data being of positive and negative polarity and corresponding to a voltage within a drive changeover range in which both the first and second buffer circuits are capable of operating; a selector, to which a polarity signal specifying polarity is input, for selecting the reference data of the positive or negative polarity based upon the value of the polarity signal; and a comparator for comparing entered digital data and the reference data output from the selector, wherein the first buffer circuit and the second buffer circuit have their activation and deactivation controlled based upon an output signal of the comparator, which indicates result of the comparison, and a control signal.

A driver circuit, in accordance with further aspect of the present invention, comprises: first and second buffer circuits having respective ones of input terminals connected commonly to one input terminal provided for receiving an input signal voltage and respective ones of output terminals connected commonly to an output terminal, the first buffer circuit having an operating range at least on the side of a high potential and the second buffer circuit having an operating range at least on the side of a low potential; reference voltage generating means for generating a reference voltage corresponding to a voltage range in which both the first and second buffer circuits are capable of operating; and a comparator for comparing the reference voltage, which is output from the reference voltage generating means, and the input signal voltage; wherein the first buffer circuit and the second buffer circuit have their activation and deactivation controlled based upon an output signal of the comparator, which indicates result of the comparison, and a control signal.

In a case where the control signal specifies activation, the first buffer circuit is placed in an operating state and the second buffer circuit is shut down if the output signal of the comparator is a value indicating that the input signal voltage is equal to or greater than the reference voltage, and the second buffer circuit is placed in the operating state and the first buffer circuit is shut down if the output signal of the comparator is a value indicating that the input signal voltage is less than the reference voltage.

In accordance with a further aspect of the present invention, there is provided a liquid crystal display device, comprising: grayscale-level voltage generating means, which has a plurality of resistors connected serially between first and second reference voltages, for generating grayscale voltages from taps thereof; and a decoder circuit, to which a digital data signal is input, for selectively outputting a corresponding voltage from output voltages of the grayscale-level voltage generating means. The above-described driver circuit according to the present invention, which receives the outputs of the decoder circuit, drives a data line that constitutes an output load.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive

BRIEF DESCRIPTION OF THE DRAWINGS

FIG. 2 is a diagram useful in describing operation of the driver circuit according to the embodiment shown in FIG. 1;

FIGS. 6A and 6B are diagrams useful in describing drive changeover voltage in a driver circuit according to the prior art serving as an example for comparative purposes, in which FIG. 6A is a diagram illustrating a liquid crystal gamma characteristic and operating range (standard state) of a driver circuit in common inversion drive, and FIG. 6B is a diagram illustrating a liquid crystal gamma characteristic and operating range (modulated) of a driver circuit in common inversion drive;

FIG. 8 is a diagram useful in describing operation of the driver circuit according to the embodiment shown in FIG. 7;

PREFERRED EMBODIMENTS OF THE INVENTION

Figure 1:
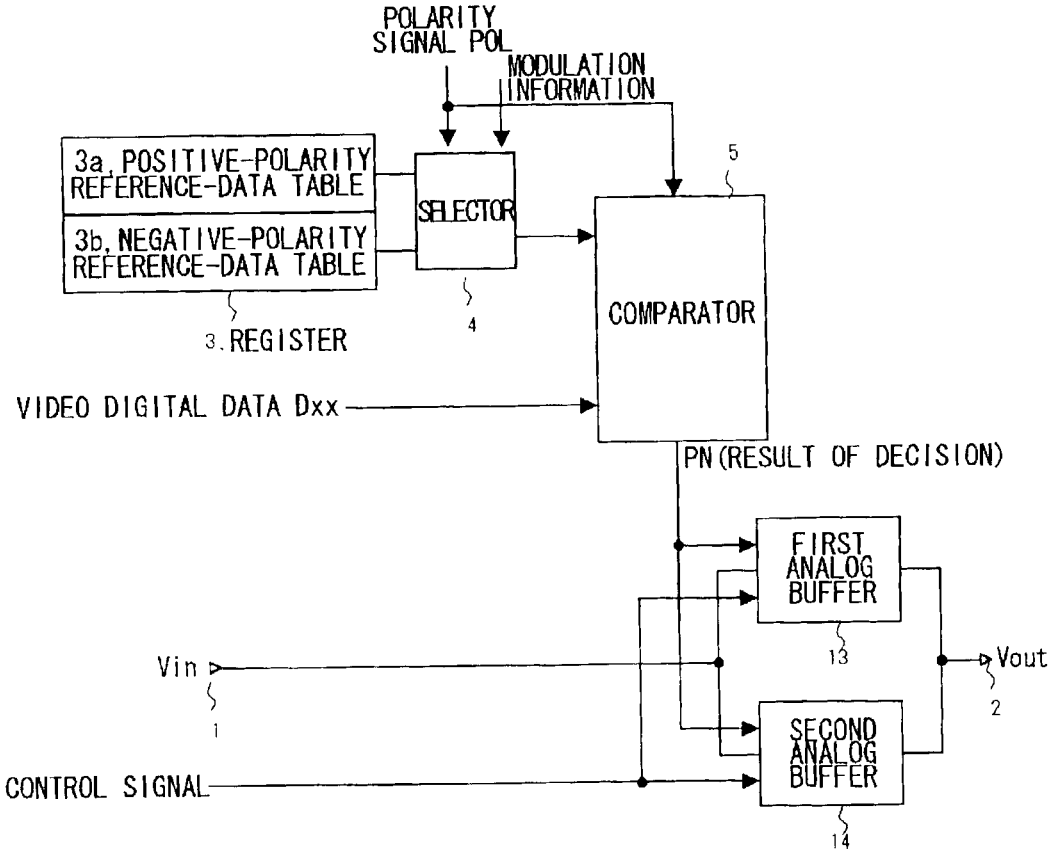
FIG. 1 is a block diagram illustrating the structure of a driver circuit according to an embodiment of the present invention.

Preferred embodiments of the present invention will be described below.

The present invention provides a driver circuit which, even if individual analog buffers thereof cannot produce a full-range output, is capable of providing a full-range output by switching between the two buffers. The optimum one of the two buffers is selected to make possible normal drive at all times even when various types of modulation are applied, Specifically, modulation of a variety of conditions is divided into a plurality of steps, and a table is provided for storing digital data, which corresponds to a grayscale level at which the two buffers are changed over, on a per-modulation-step basis The data in the table is adopted as reference data and is compared with video digital data, and the optimum buffer is selected based upon the result of the comparison.

A voltage that resides in a range in which the two buffers are capable of being changed over is adopted as a reference voltage with regard to modulation of various conditions, a selected grayscale-level voltage is compared with the reference voltage, and the optimum one of the two buffers is selected in accordance with the result of the comparison.

In accordance with one embodiment of the present invention, there is provided a driver circuit for driving an output load such as a capacitative load, comprising: a first buffer circuit (13) and a second buffer circuit (14) having their input terminals connected commonly to one input terminal (1) to which an input signal voltage (Vin) is input and their output terminals connected commonly to an output terminal (2), the first buffer circuit (13) having an operating range at least on the side of a high potential and the second buffer circuit (14) having an operating range at least on the side of a low potential; a storage unit (3) for storing reference data, which is for determining changeover between the first and second buffer circuits (13 and 14), the reference data corresponding to a voltage within a range in which both the first and second buffer circuits (13 and 14) are capable of operating; and a comparator (5) for comparing an entered data signal and the reference data. The first and second buffer circuits (13 and 14) have their activation and deactivation controlled based upon an output signal (PN) of the comparator (5), which indicates result of the comparison, and a control signal.

Alternatively, in accordance with one preferred embodiment of the present invention, there is provided a driver circuit comprising: a first buffer circuit (13) and a second buffer circuit (14) having their input terminals connected commonly to one input terminal to which an input signal voltage is input and respective ones of output terminals connected commonly to an output terminal, the first buffer circuit (13) having an operating range that extends to a high-potential power supply voltage and the second buffer circuit (14) having an operating range that extends to a low-potential power supply voltage; a storage unit (3) for storing reference data, which corresponds to an input signal voltage within a range in which both the first and second buffer circuits are capable of operating, with regard to each of a standard state and modulation state of a characteristic relating to grayscale level and signal voltage; a selector (4) for selectively outputting reference data corresponding to the standard state or modulated state based upon modulation information that specifies modulation; and a comparator (5) for comparing entered data and the reference data output from the selector; and means for controlling activation and deactivation of the first buffer circuit and the second buffer circuit based upon an output signal of the comparator, which indicates result of the comparison, and a control signal.

The storage unit (3) stores reference data, which is for determining changeover between the first and second buffer circuits, with regard to positive polarity defining a characteristic from the low-potential power supply voltage and negative polarity defining a characteristic from the high-potential power supply voltage, the reference data being of positive and negative polarity and corresponding to a voltage within a drive changeover range (see FIG. 4) in which both the first and second buffer circuits are capable of operating.

The selector (4), to which a polarity signal (POL) specifying polarity is input, selects reference data of the positive or negative polarity based upon the value of the polarity signal.

Preferably, a storage unit (3*a*) stores reference data of the positive polarity, which corresponds to an input signal voltage within a range in which both the first and second buffer circuits are capable of operating, with regard to each of a standard state and modulated state of a gamma characteristic relating to grayscale level and signal voltage.

Preferably, a storage unit (3*b*) stores reference data of the negative polarity, which corresponds to a voltage within a drive changeover range in which both the first and second buffer circuits are capable of operating, with regard to each of a standard state and modulated state of a gamma characteristic relating to grayscale level and signal voltage.

The selector (4) selects one of the storage units (3*a*, 3*b*) on the basis of a polarity signal (POL) specifying polarity and selectively outputs the reference data corresponding to the standard state or modulated state based upon modulation information specifying modulation.

A plurality of items of reference data of positive polarity, which are defined in accordance with type of modulation of the gamma characteristic, are stored in the storage unit (3*a*), a plurality of items of reference data of negative polarity, which are defined in accordance with type of modulation of the gamma characteristic, arc stored in the storage unit (3*b*), and the selector (4) selects one of the storage units (3*a*, 3*b*) based upon the polarity signal and selectively outputs the reference data conforming to the type of modulation based upon the modulation information.

In a case where the control signal specifies activation, the first buffer circuit (13) is placed in the operating state and the second buffer circuit (14) is shut down if the output signal of the comparator (5) is a value indicating that the entered data is equal to or greater than the reference data, and the second buffer circuit (14) is placed in the operating state and the first buffer circuit (13) is shut down if the output signal of the comparator (5) is a value indicating that the entered data is less than the reference data.

In accordance with one embodiment of the present invention, the polarity signal (POL) is a logic value indicating polarity, in inversion drive, of a common potential (Vcom) of opposing electrodes in a liquid crystal display device.

In accordance with the embodiment of the present invention, the storage unit (3) and selector (4) may be provided externally of the driver circuit and may be electrically connected to the driver circuit. Furthermore, the storage unit (3) may be a register, a ROM or a nonvolatile semiconductor memory device such as a writable EEPROM.

Figure 3:
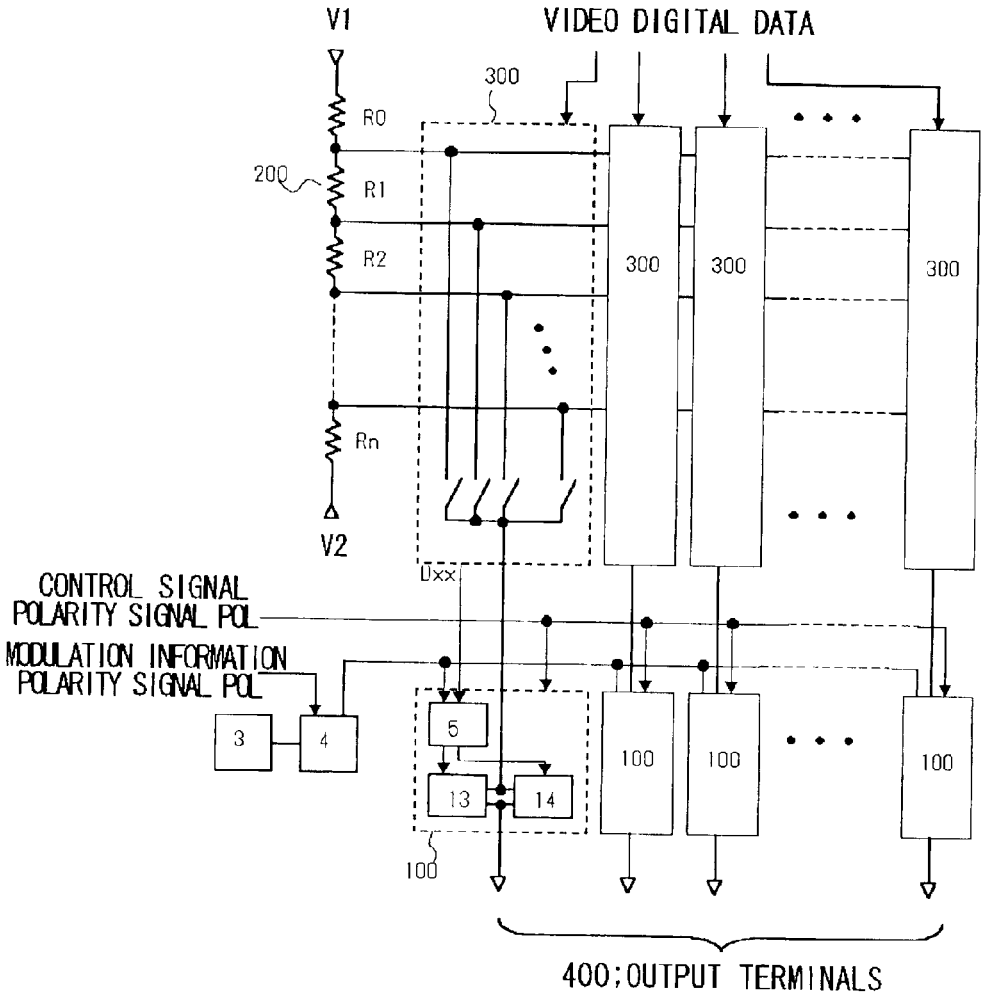
FIG. 3 is a diagram showing the structure of a multiple-output driver circuit having a plurality of the driver circuits according to the embodiment shown in FIG. 1.

As shown in FIG. 3, in the embodiment, there are provided grayscale-level voltage generating means (200), which has a plurality of resistors (R0, R1, . . . , Rn) connected serially between first and second reference voltages, for generating grayscale-level voltages from taps thereof; and a decoder circuit (300), to which a digital data signal is input, for selectively outputting a corresponding voltage from output voltages of the grayscale-level voltage generating means (200). The driver circuit according to the present invention, which receives the output of the decoder circuit (300), drives an output load. The storage unit (3) and selector (4) are provided in common for a plurality of the driver circuits, and the driver circuit preferably incorporates the comparator (5).

Figure 7:
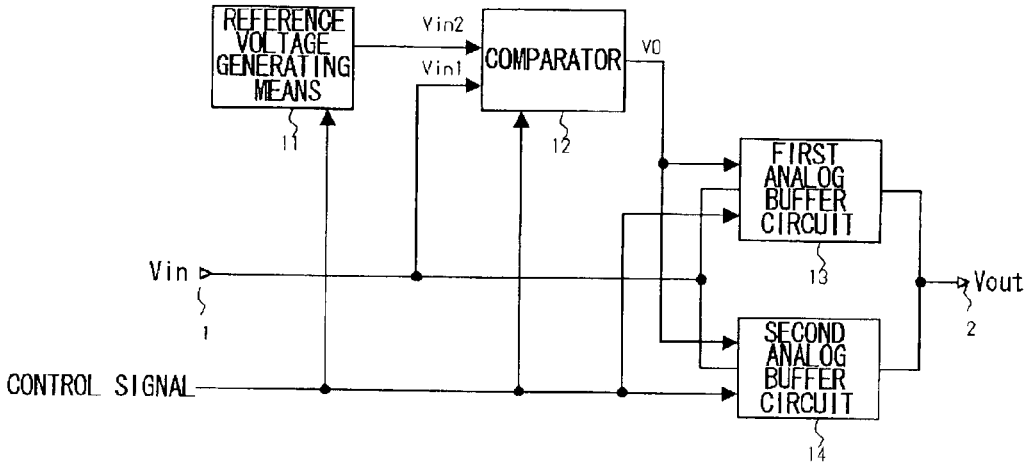
FIG. 7 is a block diagram illustrating the structure of a driver circuit according to another embodiment of the present invention.

In accordance with another embodiment of the present invention, as shown in FIG. 7, a driver circuit comprises: a first buffer circuit (13) and a second buffer circuit (14) having their input terminals connected commonly to one input terminal (1) to which an input signal voltage (Vin) is input and their output terminals connected commonly to an output terminal (2), the first buffer circuit (13) having an operating range at least on the side of a high potential and the second buffer circuit (14) having an operating range at least on the side of a low potential, reference voltage generating means (11) for generating a reference voltage Vin2 corresponding to a voltage range in which both the first and second buffer circuits are capable of operating; and a comparator (12) for comparing the reference voltage Vin2, which is output from the reference voltage generating means (11), and the input signal voltage Vin (=Vin1); wherein the first buffer circuit and the second buffer circuit have their activation and deactivation controlled based upon an output signal of the comparator (12), which indicates result of the comparison, and a control signal. In a case where the control signal specifies activation, the first buffer circuit (13) is placed in the operating state and the second buffer circuit (14) is shut down if the output signal (VO) of the comparator (12) is a value indicating that the input signal voltage Vin is equal to or greater than the reference voltage Vin2, and the second buffer circuit (14) is placed in the operating state and the first buffer circuit (13) is shut down if the output signal of the comparator is a value indicating that the input signal voltage Vin is less than the reference voltage Vin2.

In this embodiment, the driver circuit may further comprise a first logic circuit (22 in FIG. 16), to which the output signal (VO) of the comparator (12) and the control signal are input, for outputting the result of a logical operation upon the comparator output signal (VO) to the first buffer circuit when the control signal is active, and a second logic circuit (23 in FIG. 16), to which a signal that is the inverse of the output signal (VO) of the comparator (12) and the control signal are input, for outputting the result of a logical operation upon the signal that is the inverse of the comparator output signal (VO) to the second buffer circuit when the control signal is active.

Figure 9:
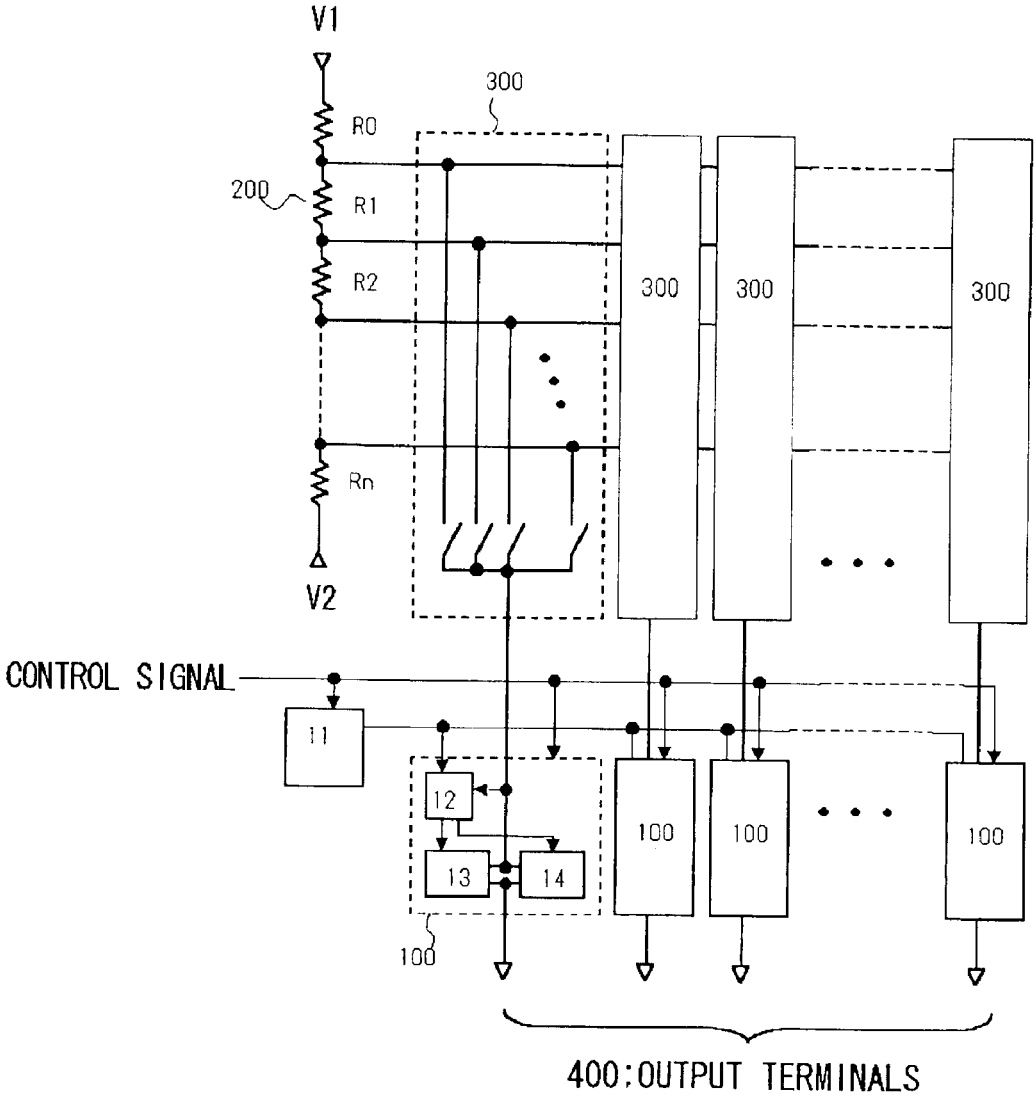
FIG. 9 is a diagram showing the structure of a multiple-output driver circuit having a plurality of the driver circuits according to the embodiment shown in FIG. 7.

In accordance with this embodiment of the invention, as shown in FIG. 9, a liquid crystal display device comprises grayscale-level voltage generating means (200), which has a plurality of resistors (R0, R1, . . . , Rn) connected serially between first and second reference voltages, for generating grayscale-level voltages from taps thereof; and a decoder circuit (300), to which a digital data signal is input, for selectively outputting a corresponding voltage from output voltages of the grayscale-level voltage generating means (200). The driver circuit according to the present invention, which receives the output of the decoder circuit (300), drives an output load. The reference voltage generating means (11) is provided in common for a plurality of the driver circuits, and the driver circuit preferably incorporates the comparator (12).

Figure 10:
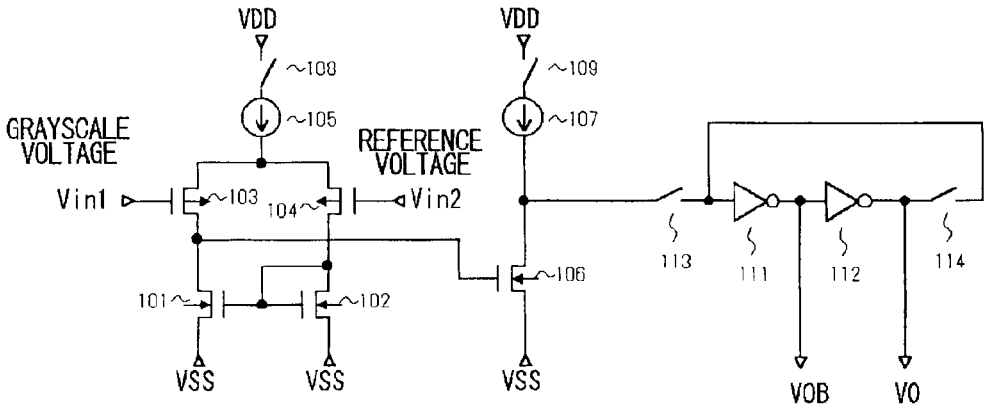
FIG. 10 is a diagram showing an example of the structure of a comparator in the driver circuit according to the embodiment shown in FIG. 7.

In accordance with this embodiment of the invention, the comparator (12), as shown in FIG. 10, includes a differential amplifier circuit the differential inputs to which are the input signal Vin (=Vin1) and the reference voltage Vin2, and a holding circuit connected to the output of the differential amplifier circuit via a switch. The holding circuit comprises a flip-flop circuit connected to one output terminal of the differential amplifier circuit via a switch (113). The flip-flop includes a first inverter (111) having an input terminal connected to the switch (113), a second inverter (112) having an input terminal connected to an output terminal of the first inverter, and a switch (114) connected between the output terminal of the second inverter and the input terminal of the first inverter. The signal from the second inverter (112) is output as the comparator output signal (VO). When the differential amplifier circuit operates, the switch (113) is turned on and the output of the differential amplifier circuit is received and latched. When this occurs, the switch (113) is turned off and the switch (114) is turned on.

The differential amplifier circuit includes a switch (108) provided between a current source (105) driving the differential pair and a power supply, and a switch (109) provided in a path for feeding power to an output stage transistor(106) which receives the output of the differential pair. These switches are turned on only when the comparator operates, as a result of which consumption of power is reduced.

When the differential amplifier circuit operates, the switches (108, 109 and 113) are turned on and the output of the differential amplifier circuit is received and latched. When this occurs, the switches (108, 109 and 113) are turned off and the switch (114) is turned on.

Figure 12:
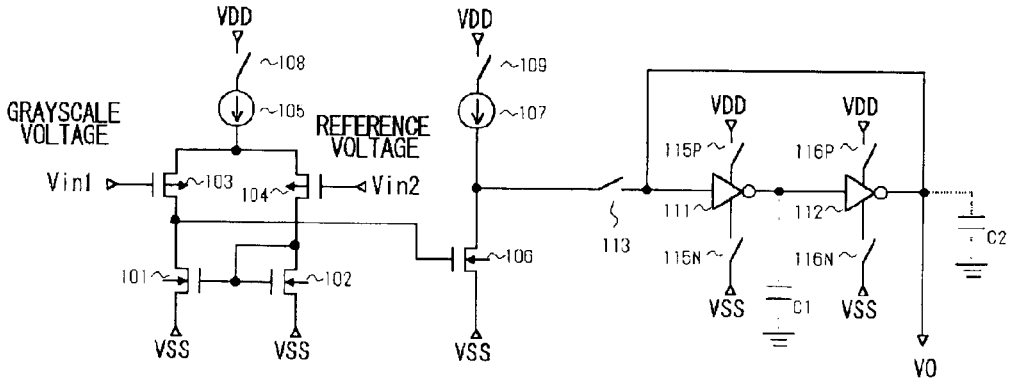
FIG. 12 is a diagram showing another example of the structure of a comparator in the driver circuit according to the embodiment shown in FIG. 7.

In accordance with this embodiment of the invention, as shown in FIG. 12, the flip-flop of the comparator includes a first clocked inverter (111) connected to the output terminal of the output transistor of the differential amplifier circuit via the switch (113), and a second clocked inverter (112) having its input terminal connected to the output terminal of the first clocked inverter. The second clocked inverter (112) has an output terminal connected to the input terminal of the first clocked inverter (111), and the signal (VO) at the output terminal of the second clocked inverter and/or the signal at the output terminal of the first clocked inverter is output as the signal representing the result of the comparison. When the differential amplifier circuit operates, the switches (108, 109 and 113) are all turned on and the output of the differential amplifier circuit is received and latched. When this occurs, the switches (108, 109 and 113) are turned off. The capacitance value of a load capacitance (C2) at the output terminal of the second clocked inverter (112) is made larger than that of the load capacitance (C1) at the output terminal of the first clocked inverter (111).

Figure 17:
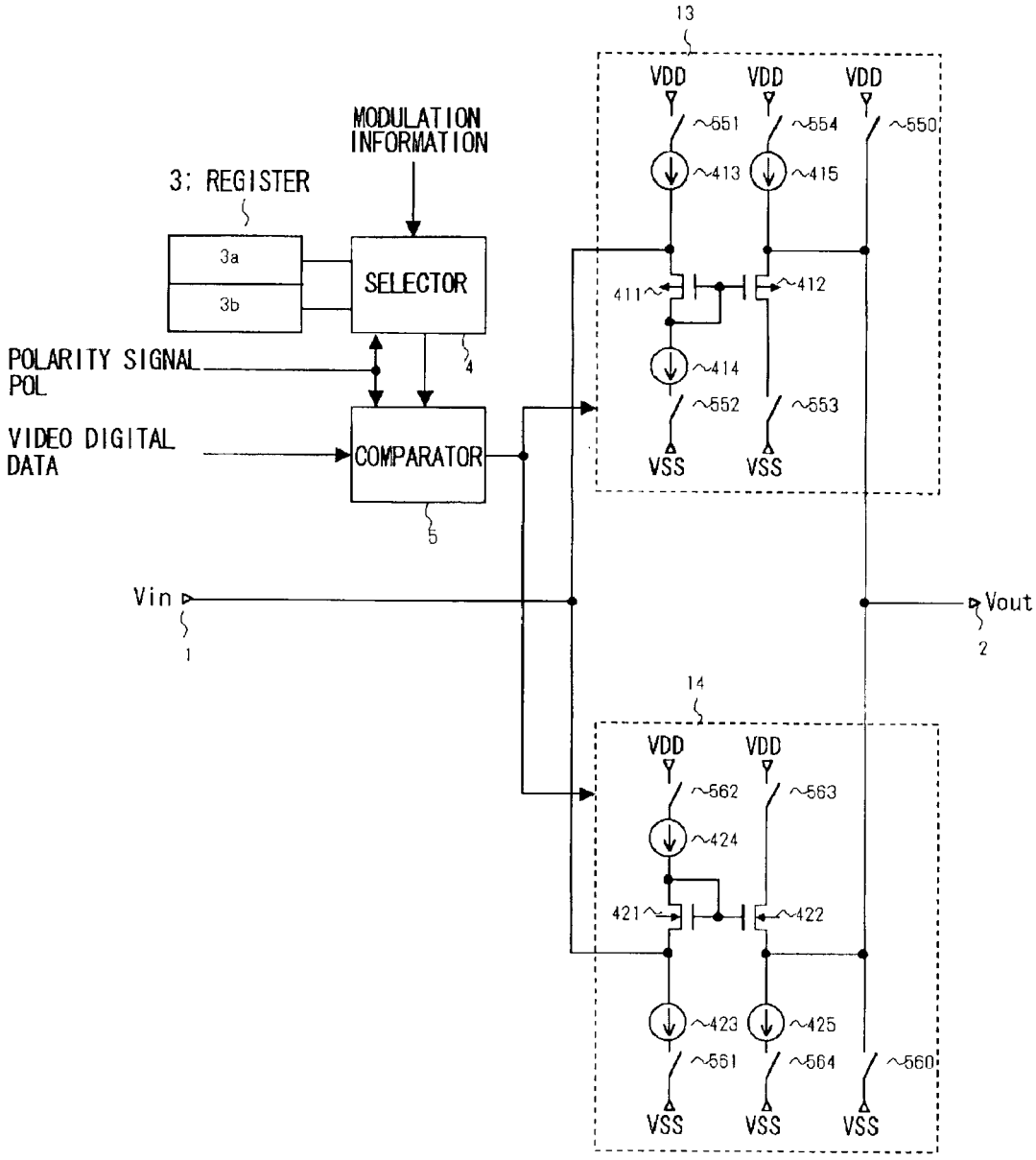
FIG. 17 is a diagram showing an example of the structure of an analog buffer circuit in the driver circuit according to the embodiment shown in FIG. 1.
Figure 18:
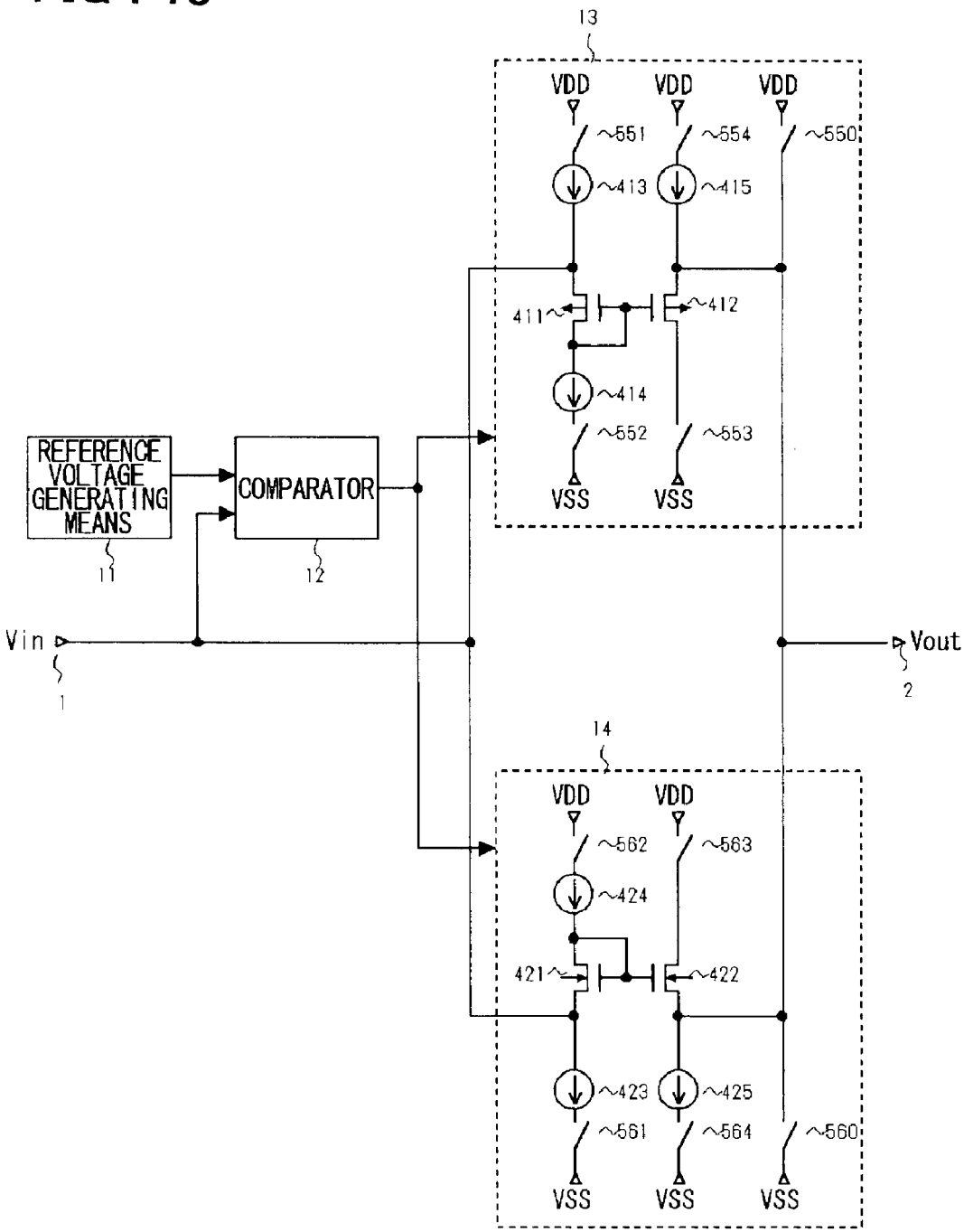
FIG. 18 is a diagram showing an example of the structure of an analog buffer circuit in the driver circuit according to the other embodiment shown in FIG. 7.

In accordance with the embodiment of the invention, as shown in FIGS. 17 and 18, the first buffer circuit (13) includes a source-follower transistor (412) connected to the low-potential power supply (VSS) and the output terminal (2), first gate-bias control means (transistor 411, current sources 414 and 413, and switches 551 and 552), to which the input signal voltage is input, for supplying the source-follower transistor (412) with a gate bias voltage, and means (550) for charging the output terminal (2).

The second buffer circuit (14) includes a source-follower transistor (422) connected to the high-potential power supply (VDD) and the output terminal (2), second gate-bias control means (transistor 421, current sources 424 and 423, and switches 561 and 562), to which the input signal voltage is input, for supplying the source-follower transistor with a gate bias voltage, and means (560) for discharging the output terminal (2).

Figure 19:
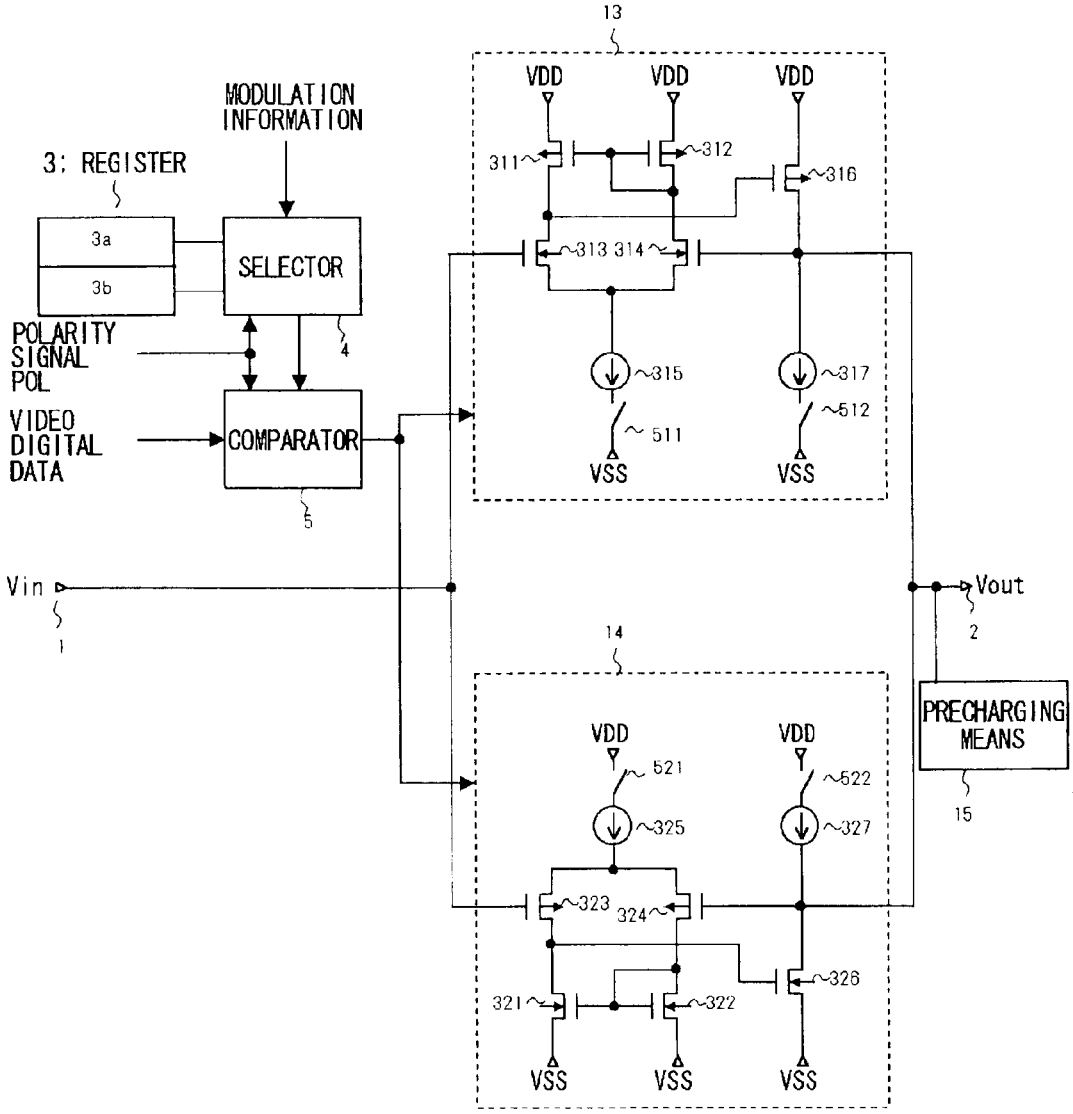
FIG. 19 is a diagram showing another example of the structure of an analog buffer circuit in the driver circuit according to the embodiment shown in FIG. 1.
Figure 20:
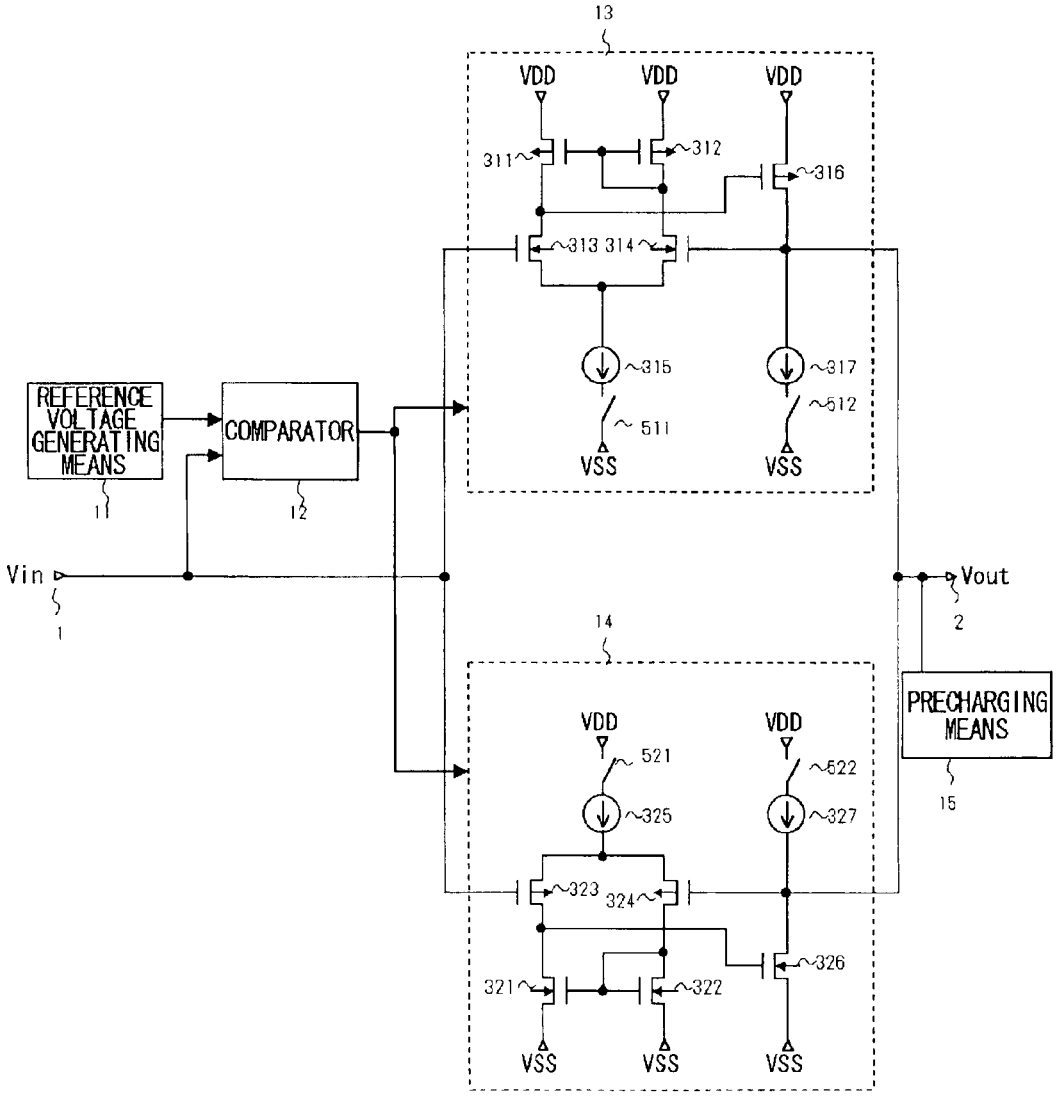
FIG. 20 is a diagram showing another example of the structure of an analog buffer circuit in the driver circuit according to the other embodiment shown in FIG. 7.

In accordance with the embodiment of the invention, as shown in FIGS. 19 and 20, the first buffer circuit (13) is constituted by a first voltage follower circuit comprising a differential amplifier circuit, which has a differential pair comprising a pair of N-channel MOS transistors (313 and 314), in which the input terminal (1) is connected to a non-inverting input terminal and the output terminal (2) is connected to an inverting input terminal. The second buffer circuit (14) is constituted by a second voltage follower circuit comprising a differential amplifier circuit, which has a differential pair comprising P-channel MOS transistors (333 and 334), in which the input terminal (1) is connected to a non-inverting input terminal and the output terminal (2) is connected to an inverting input terminal. Means (15) is provided for charging and discharging the output terminal (2).

More specifically, the first buffer circuit (13) comprises: a differential stage having a differential pair comprising a pair of N-channel MOS transistors (313 and 314), a load circuit (311 and 312) connected between the output of the differential pair and the high-potential power supply, a current source (315) for driving the differential pair, and a first switch (511) for controlling the opening and closing of the current path between the current source and the low-potential power supply; and an output stage having a MOS transistor (316), to which the output of the differential pair is input, whose output is connected to the output terminal, a current source (317) connected between the output terminal (2) and the low-potential power supply, and a switch (512). The input terminal (1) and output terminal (2) are connected to the gates of the MOS transistor pair (313 and 314) constituting the differential pair. The second buffer circuit (14) comprises: a differential stage having a differential pair (323 and 324) comprising the pair of P-channel MOS transistors, a load circuit (321 and 322) connected between the output of the differential pair and the low-potential power supply, a current source (325) for driving the differential pair, and a switch (521) for controlling the opening and closing of the current path between the current source and the high-potential power supply; and an output stage having a MOS transistor (326), to which the output of the differential pair is input, whose output is connected to the output terminal, a current source (327) connected between the output terminal (2) and the low-potential power supply, and a switch (522). The input terminal (1) and output terminal (2) are connected to the gates of the MOS transistor pair (323 and 324) constituting the differential pair.

Figure 21:
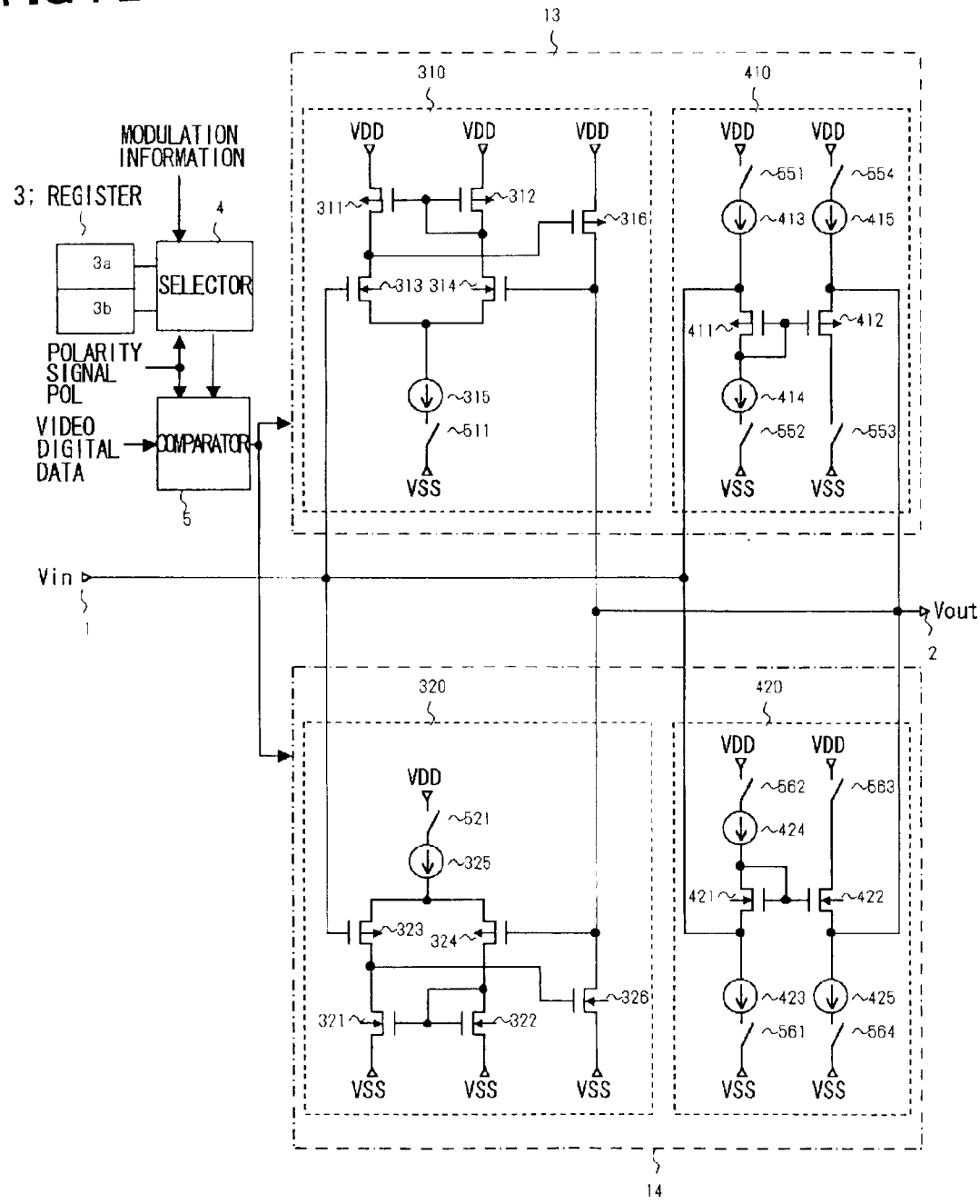
FIG. 21 is a diagram showing another example of the structure of an analog buffer circuit in the driver circuit according to the embodiment shown in FIG. 1.
Figure 22:
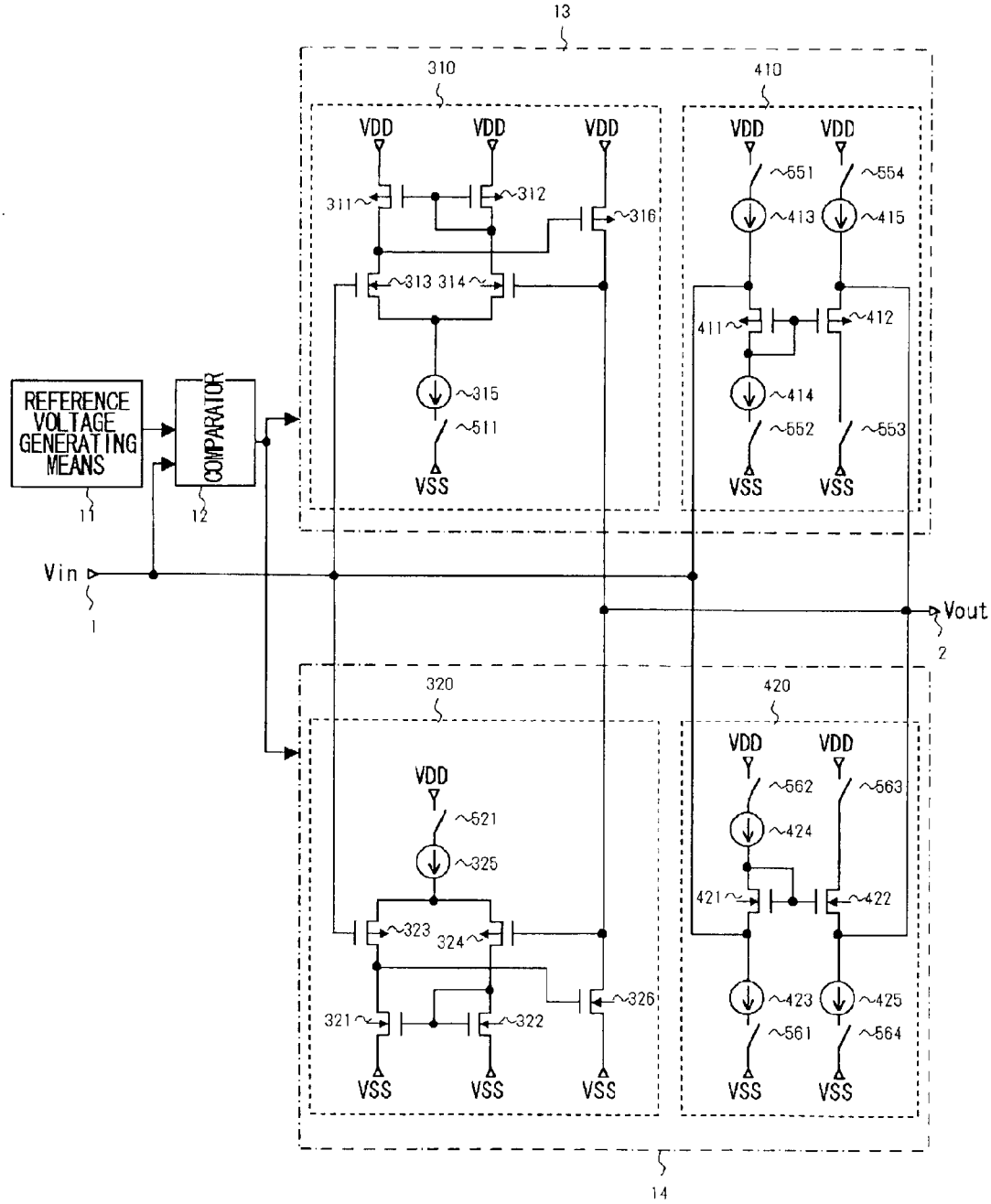
FIG. 22 is a diagram showing another example of the structure of an analog buffer circuit in the driver circuit according to the other embodiment shown in FIG. 7.

In accordance with the embodiment of the invention, as shown in FIGS. 21 and 22, the first buffer circuit (13) is constituted by a first voltage follower circuit comprising a differential amplifier circuit, which has a differential pair comprising the pair of N channel MOS transistors (313 and 314), in which the input terminal (1) is connected to a non-inverting input terminal and the output terminal (2) is connected to an inverting input terminal; a source-follower transistor (412) connected to the low-potential power supply and the output terminal; and first gate-bias control means (transistor 411, current sources 414 and 413 and switches 551 and 552), to which the input signal voltage is input, for supplying the source-follower transistor with a gate bias voltage. The second buffer circuit (14) is constituted by a second voltage follower circuit comprising a differential amplifier circuit, which has a differential pair comprising the pair of P-channel MOS transistors (323 and 324), in which the input terminal (1) is connected to a non-inverting input terminal and the output terminal (2) is connected to an inverting input terminal; a source-follower transistor (422) connected to the high-potential power supply and the output terminal; and second gate-bias control means (transistor 421, current sources 424 and 423 and switches 561 and 562), to which the input signal voltage is input, for supplying the source-follower transistor with a gate bias voltage.

In accordance with the embodiment of the invention, the reference voltage generating means (11) has a plurality of resistors (R1 and R2) and a switch (120) connected between first and second references voltages. When the switch (120) is in the ON state, a voltage within the drive changeover range, which is defined by the overlap between the operating ranges of the first and second buffers, is output as a reference voltage from the point at which the resistors are connected. It should be noted that diode-connected transistors or the like might be used as the plurality of resistors (R1 and R2).

Embodiments of the present invention will now be described in greater detail with reference to the drawings.

FIG. 1 is a block diagram illustrating the structure of a driver circuit according to an embodiment of the present invention.

As shown in FIG. 1, the driver circuit according to this embodiment comprises a register 3 having a positive-polarity reference-data table 3*a* and a negative-polarity reference-data table 3*b* for storing, for every type of modulation of a characteristic of the relation between grayscale level and voltage (inclusive also of the characteristic in the standard state thereof as a matter of course), reference data (positive-polarity reference data and negative-polarity reference data, respectively) corresponding to a grayscale level at which first and second analog buffer circuits 13, 14 are changed over; a selector 4, to which outputs of the positive-polarity reference-data table 3*a* and negative-polarity reference-data table 3*b* are input, for selecting one of the tables based upon a polarity signal POL and for selectively outputting reference data, which conforms to the modulation, based upon modulation information; comparator 5 for comparing entered video digital data and the output of the selector 4; and first and second analog buffer circuits 13 and 14, to which an output PN of the comparator, which represents the result of the comparison, and a control signal are input, for having their activation and deactivation controlled, wherein the input terminals of these buffer circuits are connected in common to an input terminal 1 and their output terminals are connected in common to an output terminal 2. The data in the positive-polarity reference-data table 3*a* and negative-polarity reference-data table 3*b* has the same bit width and the same binary expression format as those of video digital data. The comparator 5 comprises a well-known digital comparator for comparing magnitudes of two digital data. An analog voltage, which corresponds to video digital data input to the comparator 5, is applied to the input terminal 1.

At any modulation step, reference data (positive polarity and negative polarity) corresponding to the modulation step is selected by the selector 4 in accordance with the polarity signal POL, the comparator 5 compares the selected reference data and the video digital data to determine whether the grayscale level corresponding to the video digital data is lower or higher with regards to an electric potential than a changeover grayscale level, and outputs the discrimination signal PN. One of the first and second analog buffers circuits 13 and 14 is selected by the discrimination signal PN and is driven. The control signal controls the operation of the first and second analog buffer circuits 13 and 14. In Vcom inversion drive control, the polarity signal POL is placed at the high or low level depending upon whether the Vcom voltage is a low potential (positive drive) or a high potential (negative drive).

At any modulation step, reference data (positive polarity and negative polarity) corresponding to the modulation step is selected by the selector 4 in accordance with the polarity signal POL, the comparator 5 compares the selected reference data and the video digital data to determine whether the grayscale level corresponding to the video digital data is lower or higher than a changeover grayscale level, and outputs the discrimination signal PN. One of the first and second analog buffers circuits 13 and 14 is selected by the discrimination signal PN and is driven. The control signal controls the operation of the first and second analog buffer circuits 13 and 14. In Vcom inversion drive control, the polarity signal POL is placed at the high or low level depending upon whether the Vcom voltage is a low potential (positive drive) or a high potential (negative drive)

FIG. 2 is a diagram illustrating the control operation of the circuit shown in FIG. 1. When the control signal is at the low level, the first and second analog buffer circuits 13 and 14 cease operating (become inactive) irrespective of the output PN of comparator 5. When the control signal is at the high level and the output PN of the comparator 5 is at the high level, the first analog buffer circuit 13 operates and the second analog buffer circuit 14 ceases operating (becomes inactive).

When the control signal is at the high level and the output PN of the comparator 5 is at the low level, the second analog buffer circuit 14 operates and the first analog buffer circuit 13 ceases operating (becomes inactive), FIG. 3 is a diagram showing an arrangement in which the driver circuit according to this embodiment of the invention is applied to a multiple-output driver circuit. This multiple-output driver circuit is used to drive the data line of a liquid crystal display device, by way of example. As shown in FIG. 3, the multiple-output driver circuit has grayscale-level voltage generating means 200, which is composed of a resistor string obtained by serially connecting a plurality of resistance elements R0 to Rn between a power supply V1 and a power supply V2 serving as reference voltages, for outputting analog voltages, which conform to polarity, from the taps of the resistor string. The grayscale-level voltages (analog voltages) from the grayscale-level voltage generating means 200 are input to a decoder 300, to which the video digital signal is also applied. The decoder 300 selectively outputs a grayscale-level voltage corresponding to the video digital signal and inputs the voltage to a driver circuit 100. It should be noted that the grayscale-level voltage generating means 200 may be so constructed that the power supplys V1 and V2 are made fixed voltages and analog voltages conforming to polarity are output from resistor-string taps the number of which is twice the number of grayscale levels. Alternatively, an arrangement may be adopted in which the potential levels of the power supplys V1 and V2 are inverted in sync with a reversal of polarity and analog voltages conforming to polarity are output from resistor-string taps the number of which is the same as that of the number of grayscale levels.

The driver circuit 100 has the construction of the above embodiment described with reference to FIG. 1. Each driver circuit 100 includes the first and second analog buffer circuits 13 and 14 and the comparator 5. The register 3 and selector 4 are shared by each of the driver circuits 100.

Figure 4:
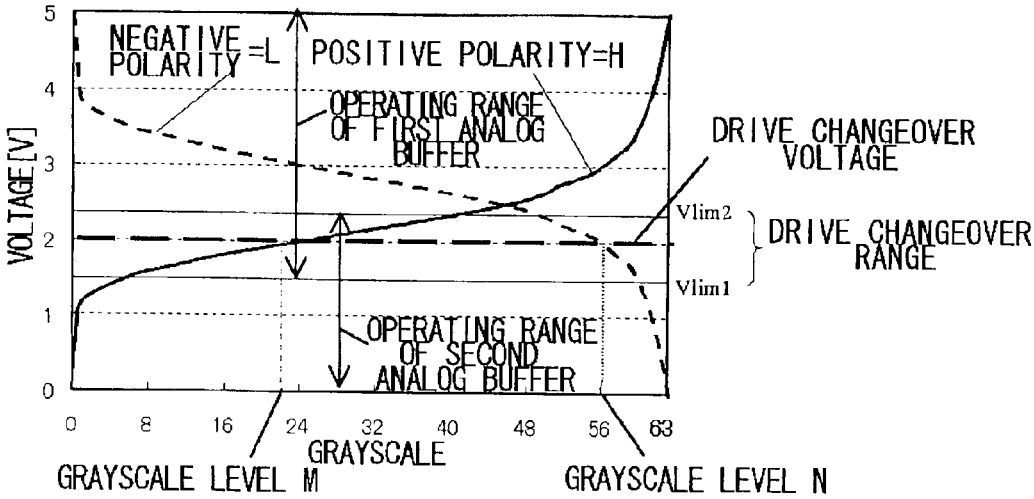
FIG. 4 is a diagram for describing drive changeover voltage in a driver circuit according to the present invention.

FIG. 4 is a diagram illustrating an example of the gamma characteristic of liquid crystal and the operating range of a driver circuit in common inversion drive. The gamma characteristic at the time of operation with positive polarity is represented by a solid line (polarity signal POL=H), and the gamma characteristic at the time of operation with negative polarity is represented by a broken line (polarity signal POL=L), Positive-polarity reference data and negative-polarity reference data has been stored in the register 3 in such a manner that drive changeover voltage Vc falls within a drive changeover range defined by limits Vlim1, Vlim2. Specifically, in accordance with this embodiment, the changeover between the first analog buffer circuit 13 and second analog buffer circuit 14 is performed by providing reference data, which corresponds to voltage Vc within the drive changeover range Vlim1 to Vlim2, for every type of modulation. In the example of FIG. 4 (which represents the standard state), the drive changeover voltage Vc is common to both the positive and negative polarities and digital data corresponding to grayscale levels M and N (positive polarity: grayscale level M; negative polarity: grayscale level N) nearest to the voltage Vc are set beforehand as standard-state reference data for each polarity. The first analog buffer circuit 13 is activated when the entered video digital data takes on a value which corresponds to a voltage equal to or greater than that of the reference data, and the second analog buffer circuit 14 is activated when the entered video digital data takes on a value of voltage less than that of the reference data.

Figure 6A:
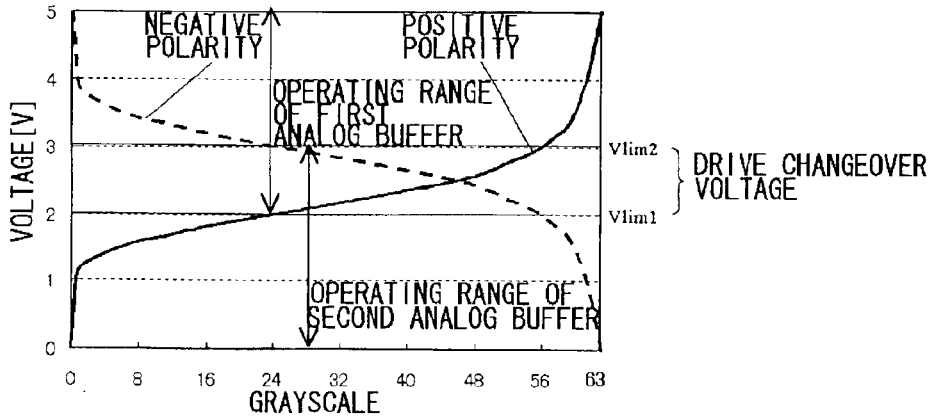
FIG . 6A PRIOR ART
Figure 6B:
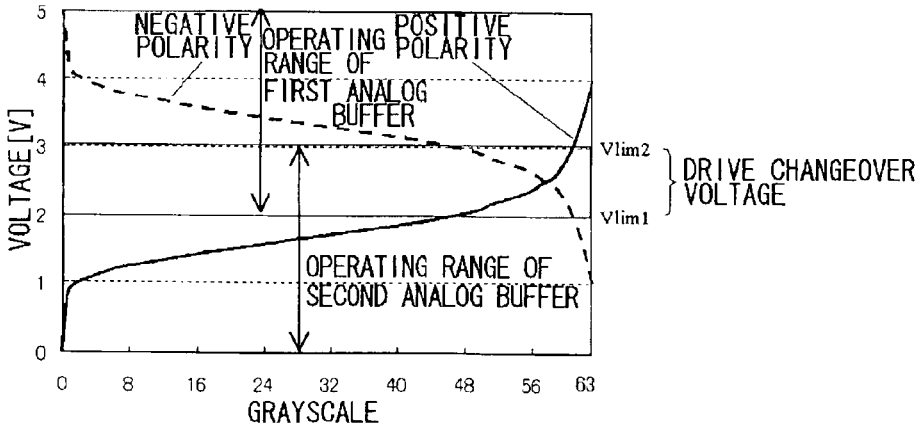
FIG . 6B PRIOR ART

Reference will now be had to FIGS. 6A, and 6B for the purpose of comparison. In a case where the changeover between a first analog buffer (which corresponds to the first analog buffer circuit 13 of FIG. 1) and a second analog buffer (which corresponds to the second analog buffer circuit 14 of FIG. 1) is performed at grayscale level 32 among grayscale levels 0 to 63 in response to one higher order bit of video digital data, the changeover is possible if the signal voltage (the entered grayscale-level voltage) corresponding to grayscale level 32 falls within the drive changeover range (Vlim1 to Vlim2) of the first and second analog buffers, as shown in FIG. 6A. In FIG. 6B, however, in which modulation has been applied, the signal voltage corresponding to grayscale level 32 falls outside the drive changeover range (Vlim1 to Vlim2). In the case of positive polarity, the output of the first analog buffer is fixed at Vlim1 between grayscale levels 32 to 48 and, in the case of negative polarity, the output of the second analog buffer is fixed at Vlim2 between grayscale levels 32 to 48. In other words, even if a video digital signal corresponding to levels 32 to 48 is input, an analog voltage corresponding to these levels will not be output and so-called "tone jump" occurs. By contrast, in accordance with the present invention, the changeover in operation between the first analog buffer and second analog buffer is performed at a voltage within the drive changeover range (Vlim1 to Vlim2). That is, control through which the modulation data prevailing at the time of changeover is varied for each type of modulation is carried out. As a result, tone jump does not occur.

Figure 5:
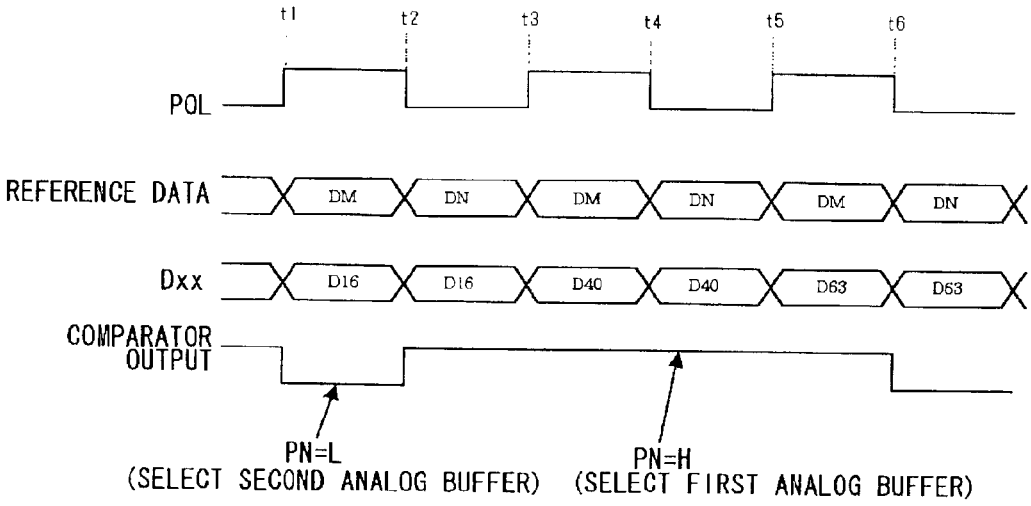
FIG. 5 is a timing chart for describing operation of the driver circuit according to the embodiment shown in FIG. 1.

FIG. 5 is a timing chart in the case of a modulation step having the gamma characteristic shown in FIG. 4. At timing t1 in FIG. 5, the polarity signal POL is at the high level and the reference data is positive-polarity data DM (data corresponding to grayscale level M). The reference data is compared with video digital data D16 corresponding to grayscale level 16, the comparator output PN changes from the high to the low level, the first analog buffer circuit 13 is changed over to the second analog buffer circuit 14 and the second analog buffer circuit 14 operates.

At time t2, the polarity signal POL assumes the low level and the reference data becomes negative-polarity data DN (data corresponding to grayscale level N). The reference data is compared with video digital data D16 corresponding to grayscale level 16, the comparator output PN changes to the high level and the first analog buffer circuit 13 is selected.

At time t3, the polarity signal POL assumes the high level and the reference data becomes positive-polarity data DM. The reference data is compared with video digital data D40 corresponding to grayscale level 40, the comparator output PN is at the high level and the first analog buffer circuit 13 is selected and activated.

At time t4, the polarity signal POL assumes the low level and the reference data becomes negative-polarity data DN. The reference data is compared with video digital data D40 corresponding to grayscale level 40, the comparator output PN is at the high level and the first analog buffer circuit 13 is selected.

At time t5, the polarity signal POL assumes the high level and the reference data becomes positive-polarity data DM. The reference data is compared with video digital data D63 corresponding to grayscale level 63, the comparator output PN is at the high level and the first analog buffer circuit 13 is selected and activated.

At time t6, the polarity signal POL assumes the low level and the reference data becomes negative-polarity data DN. The reference data is compared with video digital data D63 corresponding to grayscale level 63, the comparator output PN falls to the low level and the second analog buffer circuit 14 is selected.

FIG. 7 is a block diagram illustrating the structure of another embodiment of the present invention. As shown in FIG. 7, the driver circuit according to this embodiment comprises reference voltage generating means 11, a comparator 12 for comparing the output of the reference voltage generating means 11 and input signal voltage Vin (=Vin1), and first and second analog buffer circuits 13 and 14, to which an output VO of the comparator and a control signal are input, for having their activation and deactivation controlled, wherein the input terminals of these buffer circuits are connected in common to the input terminal 1 and their output terminals arc connected in common to the output terminal 2.

The reference voltage generating means 11 generates reference voltage Vc, at which the first and second analog buffers 13 and 14 are capable of being changed over, for each of a variety of modulation steps. That is, the reference voltage Vc is provided within a voltage range in which both the first and second analog buffers 13 and 14 are capable of operating The comparator 12 compares the grayscale-level voltage Vin, which has been selected by the video digital data, with the reference voltage Vc, and selects one of the first and second analog buffers 13, 14 in accordance with the sizes of the compared voltages, whereby the selected buffer is driven. The control signal controls the operation of the reference voltage generating means 11, comparator 12 and the first and second analog buffer circuits 13 and 14. Operation is halted except when necessary. Of course, an arrangement may be adopted in which the input signal voltage Vin is supplied to the first and second analog buffer circuits 13 and 14 upon being delayed by a delay circuit (not shown) for a length of time needed for the comparator 12 to execute comparison processing.

FIG. 8 is a diagram illustrating the control operation of the arrangement shown in FIG. 1 When the control signal is at the low level, the first and second analog buffer circuits 13 and 14 cease operating (become inactive). When the control signal is at the high level and the output PN of the comparator 12 is at the high level, the first analog buffer circuit 13 operates and the second analog buffer circuit 14 ceases operating (becomes inactive).

When the control signal is at the high level and the output of the comparator 12 is at the low level, the second analog buffer circuit 14 operates and the first analog buffer circuit 13 ceases operating (becomes inactive).

FIG. 9 is a diagram in which the driver circuit shown in FIG. 7 is applied to a multiple-output driver circuit This multiple-output driver circuit is used to drive the data line of a liquid crystal display device, by way of example. As shown in FIG. 9, the multiple-output driver circuit has the grayscale-level voltage generating means 200, which is composed of a resistor string obtained by serially connecting a plurality of resistance elements R0 to Rn between a power supply V1 and a power supply V2 serving as reference voltages, for outputting analog voltages, which conform to polarity, from the taps of the resistor string. The grayscale-level voltages (analog voltages) from the grayscale-level voltage generating means 200 are input to a decoder 300, to which the video digital signal is also applied. The decoder 300 selectively outputs a grayscale-level voltage corresponding to the video digital signal and inputs the voltage to the driver circuit 100. It should be noted that the grayscale-level voltage generating means 200 may be so constructed that the power supplys V1 and V2 are made fixed voltages and analog voltages conforming to polarity are output from resistor-string taps the number of which is twice the number of gray levels. Alternatively, an arrangement may be adopted in which the potential levels of the power supplys V1 and V2 are inverted in sync with a reversal of polarity and analog voltages conforming to polarity are output from resistor-string taps the number of which is the same as that of the number of grayscale levels.

The driver circuit 100 has the construction of the above embodiment described with reference to FIG. 7. Each driver circuit 100 includes the first and second analog buffer circuits 13 and 14 and the comparator 12. The reference voltage generating means 11 is shared by each of the driver circuits 100.

FIG. 10 is a diagram showing an example of the structure of the comparator 12 in the driver circuit according to the embodiment shown in FIG. 7.

As shown in FIG. 10, the comparator 12 includes P-channel MOS transistors 103 and 104 constituting a differential pair and having their Sources tied together and connected to one end of a constant-current source 105. The grayscale-level voltage (input signal voltage Vin) and the reference voltage are input to the gates of the P-channel MOS transistors 103 and 104, respectively, and the drains of the P-channel MOS transistors 103 and 104 are connected respectively to N-channel MOS transistors 101 and 102 (transistor 102 is on the input side and transistor 101 is on the output side), which construct a current mirror circuit. The other end of the constant-current source 105 is connected to the high-potential power supply VDD via a switch 108.

The drain of the P-channel MOS transistor 103 is connected to the gate of an N-channel MOS transistor 106 whose source is connected to the low-potential power supply VSS and whose drain is connected to one end of a constant-current source 107 The other end of the constant-current source 107 is connected to the high-potential power supply VDD via a switch 109.

The drain of the N-channel MOS transistor 106 is connected to one end of a switch (transfer switch) 113, and the other end of the switch 113 is connected to a flip-flop comprising two inverters 111 and 112. The output of the inverter 111 is connected to the input of the inverter 112, and the output of the inverter 112 is connected to the input of the inverter 111. More specifically, one end of the switch (transfer switch) 113 is connected to the input terminal of the inverter 111, the output terminal of the inverter 111 is connected to the input terminal of the inverter 112, and the output terminal of the inverter 112 is connected to the input terminal of the inverter 111 via the switch 114. The outputs of the inverters 111 and 112 are extracted as the outputs VOB and VO, respectively.

Figure 11:
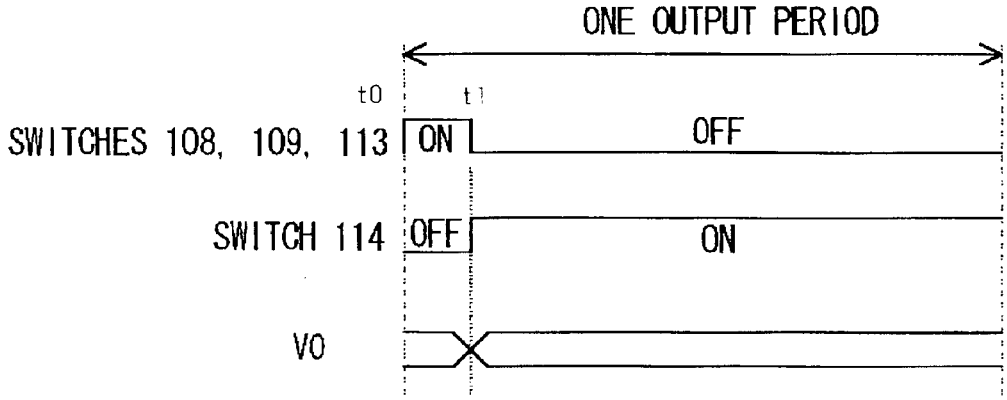
FIG. 11 is a diagram useful in describing operation of the comparator shown in FIG. 10.

FIG. 11 is a timing chart useful in describing the operation of the comparator 12 having the circuit structure shown in FIG. 10. When the switches 108, 109, 113 are turned on and the switch 114 turned off by the control signal, the differential amplifier circuit is activated and the result of the comparison is transmitted to the flip-flop.

The operation of the comparator 12 shown in FIG. 10 will now be described. First, assume that the switches 108, 109, 113 are on and that the switch 114 is off, so that the differential amplifier circuit is operating and the grayscale-level voltage and reference voltage is compared. When the grayscale-level voltage Vin1 is lower than the reference voltage Vin2, the transistor 103 has a larger drain current than that of the transistor 104, the gate voltage of the N-channel MOS transistor 106 increases and the potential at the connection between the drain of transistor 106 and the constant-current source 107 takes on the low-potential level. When the grayscale-level voltage Vin1 is higher than the reference voltage Vin2, a larger drain current flows into the transistor 104, the gate voltage of the N-channel MOS transistor 106 decreases and the potential at the connection between the drain of transistor 106 and the constant-current source 107 takes on the high-potential level. The output of the differential circuit is input to the inverter 111 via the switch 113 (this switch 114 is off at this time).

The switch 113 is turned off (and so are the switches 108, 109), the switch 114 is turned on, the flip-flop is constructed by the two inverter stages, and the input data (result of the comparison) of inverter 111 is latched and output as VO FIG. 12 is a diagram showing another structure of the comparator 12 according to this embodiment of the invention. The power consumption of the comparator shown in FIG. 12 is lower than that of a circuit shown in FIG. 10.

As shown in FIG. 12, the structure of the differential circuit is similar to that shown in FIG. 11. With regard to the flip-flop, a switch 115P is provided in a power feeding path between the high-potential power supply VDD and the high-potential power supply terminal of the inverter 111, and a switch 115N is provided in a power feeding path between the low-potential power supply VSS and the low-potential power supply terminal of the inverter 111. Further, a switch 116P is provided between the high-potential power supply VDD and the power supply path of the inverter 112, and a switch 115N is provided between the low-potential power supply VSS and the power supply path of the inverter 112. The switch 114 in FIG. 11 is eliminated. A storage operation is performed utilizing stored charge in a parasitic capacitance C1 at the output of the inverter 111 and a parasitic capacitance C2 at the output of the inverter 112. The capacitance C2 is made larger than the capacitance C1. The duration of charge/discharge of capacitance C1 by the inverter 111 is made shorter than that of charge/discharge of capacitance C2 by the inverter 112 As a result, operation of the flip-flop is stabilized.

Figure 13:
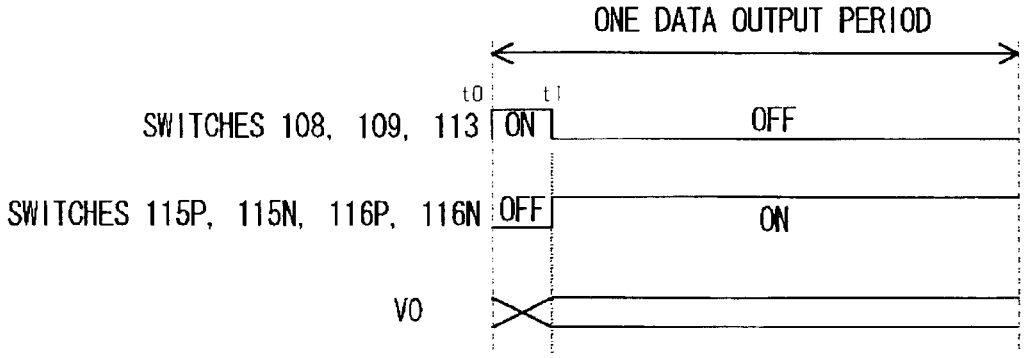
FIG. 13 is a diagram useful in describing operation of the comparator shown in FIG. 12.

FIG. 13 is a timing chart illustrating the operation of the circuit shown in FIG. 12. Over the initial part of the length of one output period, the switches 108, 109 and 113 are turned on, the result of the comparison from the differential circuit is transmitted to the input terminal of the inverter 111 of the flip-flop and the switches 115P, 115N, 116P and 116N are turned off. Next, the switches 108, 109 and 113 are turned off, the switches 115P, 115N, 116P and 116N are turned on and the flip-flop stores data.

It should be noted that by establishing the relation C2>C1 with regard to the load capacitance C2 of inverter 112 and the load capacitance Cl of inverter 111, malfunction could be prevented. That is, the rise time and decay time of the signal resulting from the charging and discharging of the output load of inverter 11 is set to be shorter than in the case of the inverter 112. Operation of the flip-flop is stabilized as a result.

When the switch 113 is ON, the output of the differential circuit charges or discharges the capacitance C2 and the output VO of the comparator is caused to change before time t1 at which the switch 113 is turned off It should be noted that if the current controlled by the constant-current sources 105 and 107 is kept sufficiently small in the comparator of FIG. 12, the change in input potential of the inverter 111 while the switches 108, 109 and 113 are ON will become more gentle. However, since the switches 115P, 115N, 116P and 116N are OFF, feedthrough current does not occur in the inverters 111 and 112 If the switches 108, 109 and 113 are turned off and the switches 115P, 115N, 116P and 116N are turned on after the input potential of the inverter 111 stabilizes at the high or low level, then the inverters 111 and 112 will operate immediately and the comparator can be operated without loss due to power consumption ascribable to feedthrough current. Further, though not shown in FIG. 12, a switch is provided in the power supply path of the circuit to which the output VO of the comparator is input, and good effects can be obtained if the switch is controlled in sync with the switches 115P, 115N, 116P and 116N. On the other hand, if current controlled by the constant-current sources 105 and 107 is kept sufficiently small in the comparator of FIG. 10, loss due to power consumption ascribable to feedthrough current of the inverters 111 and 112 increases and, as a result, a sufficiently low power consumption cannot be achieved.

Figure 14:
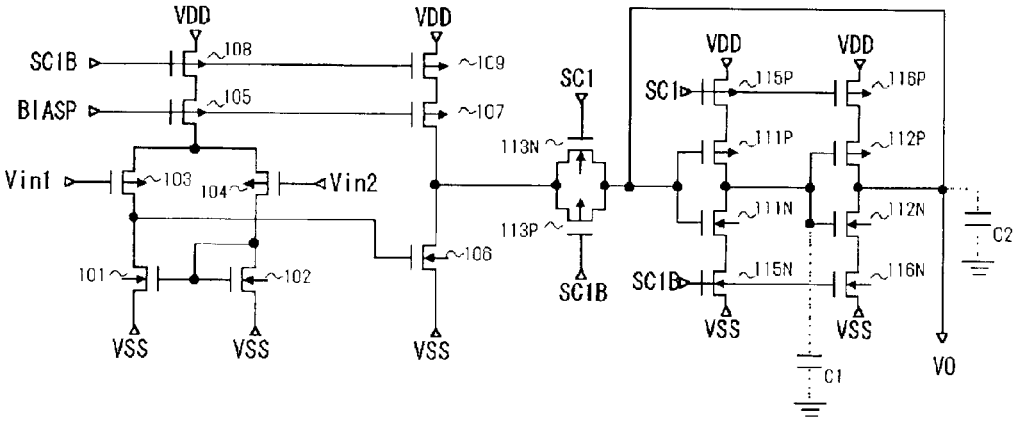
FIG. 14 is a diagram showing another example of the structure of a comparator in the driver circuit according to the embodiment shown in FIG. 12.

FIG. 14 is a diagram illustrating transistor levels in the circuit arrangement shown in FIG. 12. As shown in FIG. 14, the constant-current sources 105, 107 of FIG. 12 are constructed by P-channel MOS transistors having a bias voltage BIASP supplied to the gates thereof, and the switches 108 and 109 of FIG. 12 are constructed by P-channel MOS transistors having a gate signal SC1B (a signal that is the inverse of SC1) supplied to the gates thereof.

Further, as shown in FIG. 14, the switch 113 of FIG. 12 comprises a CMOS transfer gate, the control signal SC1B is supplied to the gate of P-channel MOS transistor 113P, and the control signal SC1 is supplied to the gate of N-channel MOS transistor 113N. The switch 113 turns on when the control signal SCI is high.

The inverter 111, which is a clocked inverter, comprises a P-channel MOS transistor 111P and an N-channel MOS transistor 111N having their gates tied together, their drains tied together and constructing a CMOS (complementary MOS) inverter; a P-channel MOS transistor 115P having a source connected to the power supply VDD, a gate connected to the control signal SC1 and a drain connected to the source of the P-channel MOS transistor 111P; and an N-channel MOS transistor 115N having a gate connected to the control signal SC1B and a drain connected to the source of the N-channel MOS transistor 111N.

The inverter 112, which is a clocked inverter, comprises a P-channel MOS transistor 112P and an N-channel MOS transistor 112N having their gates tied together, their drains tied together and constructing a CMOS inverter; a P-channel MOS transistor 116P having a source connected to the power supply VDD, a gate connected to the control signal SC1 and a drain connected to the source of the P-channel MOS transistor 112P; and an N-channel MOS transistor 116N having a gate connected to the control signal SC1B and a drain connected to the source of the N-channel MOS transistor 112N.

Figure 15:
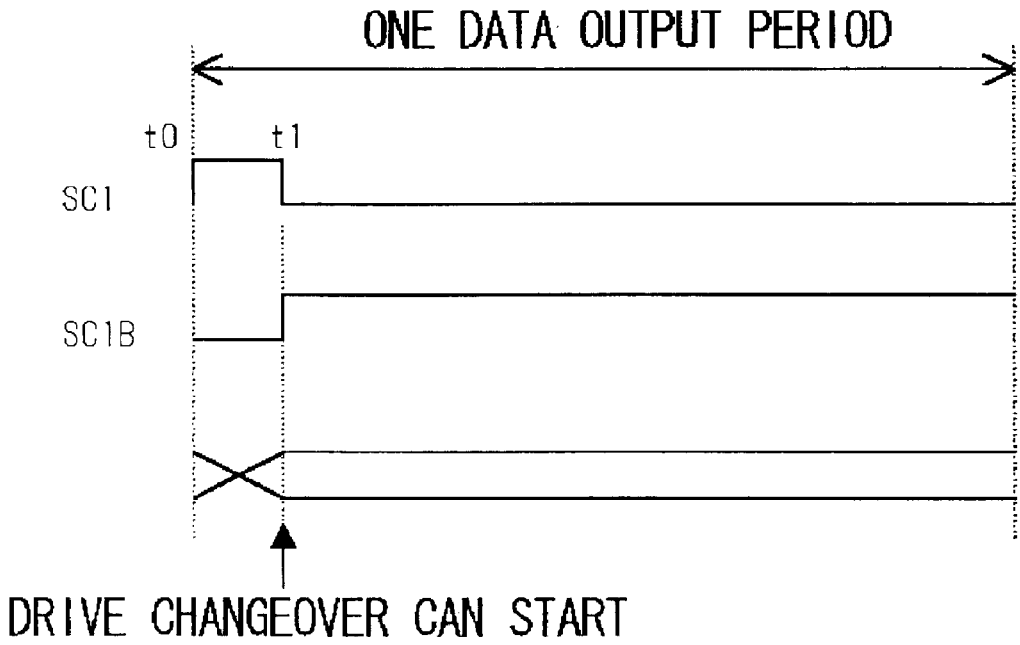
FIG. 15 is a diagram useful in describing operation of the comparator shown in FIG. 14.

FIG. 15 is a timing chart illustrating the operation of the comparator shown in FIG. 14. Over the initial part (t0 to t1) of the length of one output period, the control signal SC1 is placed at the high level (ON) (SC1B is at the low level). On a succeeding period, the control signal SC1 is then placed at the low level (SC1B is placed at the high level). With the control signal SC1 at the high level, the differential circuit is activated, switch 13 turns on and the inverters 11 and 12 are deactivated. With the control signal SC1 at the low level, switch 13 turns off and inverters 11 and 12 are activated.

Figures 16A, 16B:
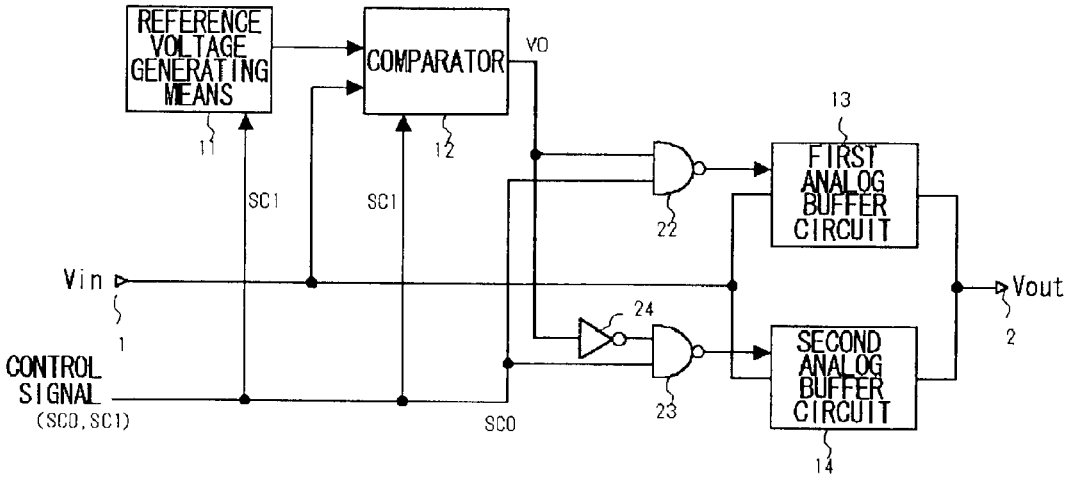
FIG. 16A is a diagram showing another example of the structure of the driver circuit according to the embodiment shown in FIG. 7.
FIG. 16B is a diagram useful in describing the operation thereof.

FIG. 16A is a diagram showing the structure of another embodiment of the present invention. As shown in FIG. 16A, this circuit includes the reference voltage generating means 11, the comparator 12, the first analog buffer circuit 13 and the second analog buffer circuit 14. The circuit further includes a NAND gate 22 the inputs to which are the output VO of the comparator 12 and a control signal SC0, and a NAND gate 23 the inputs to which are a signal, which is obtained by inverting the output VO of the comparator 12 by an inverter 24, and the control signal SC0. The outputs of the NAND gates 22 and 23 are supplied to the first analog buffer circuit 13 and second analog buffer circuit 14 as control signals.

It should be noted that the control signal SC1 controls the operation of the reference voltage generating means 11 and the comparator 12 shown in FIG. 14.

FIG. 16B is a timing chart useful in describing the operation of the circuit shown in FIG. 16A. Here SC0 represents the control signal and VO the output of comparator 12. When SC0 is at the low level, the outputs of NAND gates 22 and 23 are at the high level When SC0 is at the high level, NAND gate 22 outputs a signal that is the inverse of VO and NAND gate 23 outputs VO.

FIG. 17 is a diagram showing an example of the structure of the analog buffer circuits 13 and 14 in the driver circuit shown in FIG. 1.

As shown in FIG. 17, the first analog buffer circuit 13 includes a constant-current source 413 and a switch 551 connected in series between the input terminal 1 and high-potential power supply VDD; a P-channel MOS transistor 411 having a source connected to the input terminal 1 and a gate and drain that are connected together; a constant-current source 414 and a switch 552 connected in series between the drain of the P-channel MOS transistor 411 and low-potential power supply VSS; a constant-current source 415 and a switch 554 connected in series between the output terminal 2 and high-potential power supply VDD; and a P-channel MOS transistor 412 having a source connected to the output terminal 2, a gate connected in common with the gate of the P-channel MOS transistor 411, and a drain connected to the low-potential power supply VSS via a switch 553. A switch 550 is connected between the output terminal 2 and high-potential power supply VDD and in parallel with the series circuit composed of the constant-current source 415 and switch 554.

The second analog buffer circuit 14 includes a constant-current source 423 and a switch 561 connected in series between the input terminal 1 and low-potential power supply VSS; an N-channel MOS transistor 421 having a source connected to the input terminal 1 and a gate and drain that are connected together; a constant-current source 424 and a switch 562 connected in series between the drain of the N-channel MOS transistor 421 and high-potential power supply VDD; a constant-current source 425 and a switch 564 connected in series between the output terminal 2 and low-potential power supply VSS; and an N-channel MOS transistor 422 having a source connected to the output terminal 2, a gate connected in common with the gate of the N-channel MOS transistor 421, and a drain connected to the high-potential power supply VDD via a switch 563. A switch 560 is connected between the output terminal 2 and low-potential power supply VSS and in parallel with the series circuit composed of the constant-current source 425 and switch 564.

An example of operation of the first analog buffer circuit 13 will now be described. Control is performed in response to control signals in such a manner that switch 550 is turned on and switches 551, 552, 553 and 554 turned off, switches 551 and 552 are then turned on, after which switch 550 is turned off and switches 553 and 554 turned on.

When switches 551 and 552 are turned on, a common-gate potential VG1 of the transistors 411 and 412 becomes a voltage shifted from the input signal voltage Vin by a gate-source voltage Vgs1 of the transistor 411 owing to the action of transistor 411. Specifically, we have $$VG1=Vin+Vgs1 \quad (1)$$

It should be noted that the gate-source voltage Vgs is represented by the potential of the gate with respect to the source.

The transistor has a unique VI characteristic between drain-source current Ids and gate-source voltage Vgs, and the gate-source voltage Vgs1 of transistor 411 is uniquely decided by the Ids-Vgs characteristic of the transistor 411 and current I1 controlled by the constant-current source 414.

Let the gate-source voltage that prevails when the drain-source current of the transistor 411 becomes I1 (the current value of the constant-current source 414) be represented by Vgs1 (I1). In such case the gate voltage VG1 of the transistor 411 stabilizes at $$VG1=Vin+Vgs1(I1) \quad (2)$$

When the voltage VG1 is applied to the gate of the transistor 412, the output voltage Vout becomes a voltage shifted from the voltage VG1 by a gate-source voltage Vgs2 of the transistor 412. Specifically, we have $$Vout=VG1-Vgs2 \quad (3)$$

The output voltage Vout stabilizes when the drain-source current of transistor 412 becomes equal to I3 (the current value of constant-current source 415). The gate-source voltage Vgs2 of transistor 412 at this time becomes Vgs2(I3) owing to the Ids-Vgs characteristic of transistor 412 and the current I3. The output voltage Vout stabilizes at $$Vout=VG1-Vgs2(I3) \quad (4)$$

From Equations (2) and (4), the output voltage Vout that prevails when the input signal voltage Vin is constant becomes $$Vout=Vin+Vgs1(I1)-Vgs2(I3) \quad (5)$$

The output-voltage range at this time becomes narrower than the voltage range between power supply voltage VDD and power supply voltage VSS by a voltage difference equivalent to at least the gate-source voltage Vgs2(I3) of transistor 412. If currents I1 and I3 of constant-current sources 414 and 415, respectively, are controlled in such a manner that gate-source voltages Vgs1(I1) and Vgs2(I3) of transistors 411 and 412, respectively, become equal, then the output voltage Vout becomes a voltage equal to the input signal voltage Vin on the basis of Equation (5). Further, even if the transistor characteristic fluctuates, a highly precise voltage output can be produced, irrespective of this fluctuation, by setting the element sizes and currents I1 and I3 of the transistors 411 and 412 in such a manner that $$Vgs1(I1)-Vgs2(I3)$$

will not change.

More specifically, a voltage output that is independent of threshold voltage fluctuation of the transistors can be produced by setting the element sizes of the transistors 411 and 412 and currents I1 and I3 so as to be equal, or by uniformalizing the channel lengths of the transistors 411 and 412 and setting the currents I1 and I3 in accordance with the channel-width ratio. Further, if the current I2 of constant-current source 413 is controlled so as to become equal to the current I1 of constant-current source 414, the buffer circuits can be operated with ease even in case of a low current supplying capability for the external circuit that supplies the input signal voltage Vin. It should be noted that the buffer circuits can operate even in the absence of the constant-current source 413. In such case, however, it is required that the external circuit that supplies the input signals voltage Vin has a satisfactory current supply capability.

Further, with regard to operation of the first analog buffer circuit 13, by charging the output terminal 2 to the voltage VDD in the first half of one output period by controlling the switch 550, the transistor 412 can be made to perform a source-follower operation with respect to any input signal voltage Vin so that the output terminal 2 can be driven rapidly to the voltage represented by Equation (5) above.

It should be noted that the current supplying capability by the source-follower operation of the transistor 412 declines as the gate-source voltage of the transistor 412 approaches the threshold voltage. Nevertheless, the capability to supply the current I3 is maintained even at minimum. By adjusting current I3, therefore, the driving capability of the buffer circuits and the consumed current can be changed. As mentioned above, the buffer circuits possess a high driving capability despite a simple structure. By setting the element sizes of the transistors 411 and 412 and currents I1 and I3 taking into account a fluctuation in transistor characteristics, a highly precise voltage output can be realized regardless of this fluctuation.

An example of operation of the second analog buffer circuit 14 will now be described. Control is performed in response to control signals in such a manner that switch 560 is turned on and switches 561, 562, 563 and 564 turned off, switches 561 and 562 are then turned on, after which switch 560 is turned off and switches 563 and 564 turned on.

When switches 561 and 562 are turned on, a common-gate potential VG2 of the transistors 421 and 422 becomes a voltage shifted from the input signal voltage Vin by a gate-source voltage Vgs3 of the transistor 421 owing to the action of transistor 421. Specifically, we have $$VG2=Vin+Vgs3 \quad (1)'$$

The transistor has a unique VI characteristic between drain-source current Ids and gate-source voltage Vgs, and the gate-source voltage Vgs3 of transistor 421 is uniquely decided by the Ids-Vgs characteristic of the transistor 421 and current I.

Let the gate-source voltage that prevails when the drain-source current of the transistor 421 becomes I4 (the current value of the constant-current source 424) be represented by Vgs3(I4). In such case the gate voltage VG2 of transistor 421 stabilizes at $$VG2=Vin+Vgs3(I4) \quad (2)'$$

When the voltage VG2 is applied to the gate of the transistor 422, the output voltage Vout becomes a voltage shifted from the voltage VG2 by a gate-source voltage Vgs4 of the transistor 422. Specifically, we have $$Vout=VG2-Vgs4 \quad (3)'$$

The output voltage Vout stabilizes when the drain-source current of transistor 422 becomes equal to I5 (the current value of constant-current source 425). The gate-source voltage Vgs4 of transistor 422 at this time becomes Vgs4(I5) owing to the Ids-Vgs characteristic of transistor 422 and the current I5. The output voltage Vout stabilizes at $$Vout=VG2-Vgs4(I5) \quad (4)'$$

From Equations (2)' and (4)', the output voltage Vout that prevails when the input signal voltage Vin is constant becomes $$Vout=Vin+Vgs3(I4)-Vgs4(I5) \quad (5)'$$

The output-voltage range at this time becomes narrower than the voltage range between power supply voltage VDD and power supply voltage VSS by a voltage difference equivalent to at least the gate-source voltage Vgs4(I5) of transistor 422. If currents I4, I5 of constant-current sources 424 and 425, respectively, are controlled in such a manner that gate-source voltages Vgs3(I4) and Vgs4(I5) of transistors 421 and 422, respectively, become equal, then the output voltage Vout becomes a voltage equal to the input signal voltage Vin on the basis of Equation (5)'. Further, even if the transistor characteristic fluctuates, a highly precise voltage output can be produced, irrespective of this fluctuation, by setting the element sizes and currents I4 and I5 of the transistors 421 and 422 in such a manner that $$Vgs3(I4)-Vgs4(I5)$$

will not change.

More specifically, a voltage output that is independent of threshold-voltage fluctuation of the transistors can be produced by setting the element sizes of the transistors 421 and 422 and currents I4 and I5 so as to be equal, or by setting uniformalizing the channel lengths of the transistors 421 and 422 and setting the currents I4, I5 in accordance with the channel-width ratio. Further, if the current I6 of constant-current source 423 is controlled so as to become equal to the current I4 of constant-current source 424, the buffer circuits can be operated with ease even in case of a low current supplying capability for the external circuit that supplies the input signal voltage Vin. It should be noted that the buffer circuits can operate even in the absence of the constant-current source 423. In such case, however, it is required that the external circuit that supplies the input signals voltage Vin has a satisfactory current supply capability.

Further, with regard to operation of the second analog buffer circuit I4, by discharging the output terminal 2 to the voltage VSS in the first half of one output period by controlling the switch 560, the transistor 422 can be made to perform a source-follower operation with respect to any input signal voltage Vin so that the output terminal 2 can be driven rapidly to the voltage represented by Equation (5)' above It should be noted that the current supplying capability by the source-follower operation of the transistor 422 declines as the gate-source voltage of the transistor 422 approaches the threshold voltage. Nevertheless, the capability to supply the current I5 is maintained even at minimum. By adjusting current I5, therefore, the driving capability of the buffer circuits and the consumed current can be changed. As mentioned above, the buffer circuits possess a high driving capability despite a simple structure. By setting the element sizes of the transistors 421 and 422 and currents I4, and I5 taking into account a fluctuation in transistor characteristics, a highly precise voltage output that is independent of this fluctuation can be realized.

FIG. 18 is a diagram illustrating an example of the structure of the first and second analog buffer circuits 13 and 14 according to the embodiment shown in FIG. 7. The structure and operation of these circuits are as described above with reference to FIG. 17 and need not be described again.

FIG. 19 is a diagram illustrating an example of the structure of the first and second analog buffer circuits 13 and 14 according to the embodiment shown in FIG. 1. In this arrangement, the first and second analog buffer circuits 13 and 14 are constituted by voltage followers using a differential amplifier circuit, and precharging means 15 for preliminarily discharging and charging the output terminal 2 is provided.

As shown in FIG. 19, the first analog buffer circuit 13 is composed of a differential stage and an output stage. The differential stage has a current mirror circuit comprising P channel MOS transistors 311 and 322, a differential pair 313 and 314 comprising respective ones of N-channel MOS transistors of the same size, a constant-current circuit 315 and a switch 511. More specifically, the differential stage has N-channel MOS transistors 313 and 314, which constitute a differential pair, in which the sources thereof are tied together and connected to one end of the constant-current source 315 and the gates thereof are connected to input terminal 1 (Vin) and output terminal 2 (Vout), respectively; a P-channel MOS transistor 311 (which forms the . transistor on the current-output side of the current mirror) having a source connected to the high-potential power supply VDD, a gate connected to the gate of the P-channel MOS transistor 312 and a drain connected to the drain of the N-channel MOS transistor 313; a P-channel MOS transistor 312 (which forms the transistor on the current-input side of the current mirror) having a source connected to the high-potential power supply VDD, and a gate and drain tied together and connected to the drain of the N-channel MOS transistor 314; and a switch 511 connected between the other end of the constant-current source 315 and the low-potential power supply VSS. The N-channel MOS transistors 313 and 314 forming the differential pair are of the same size. The drain of the N-channel MOS transistor 313 serves as the output terminal.

The output stage includes a P-channel MOS transistor 316 having a drain connected to the output terminal 2, a gate to which the output voltage of the differential circuit (the drain voltage of the N-channel MOS transistor 313) is input, and a source connected to the high-potential power supply VDD; and a current source 317 and switch 512 connected between the output terminal 2 and the low-potential power supply VSS. It should be noted that the P-channel MOS transistor 316 may be replaced by an N-channel MOS transistor having a booster circuit connected to the drain thereof. It should be noted that a phase compensating capacitor for stabilizing the output might be provided between the output terminal of the differential circuit and the output terminal 2.

Switches 511 and 512 have control terminals connected to control signals so as to be turned on and off. When these switches are off, current is cut off and operation of the circuit ceases The switches may be placed at positions different from those shown in FIG. 19 so long as they can cut off the flow of current.

The second analog buffer circuit 14 is composed of a current-mirror circuit comprising N-channel MOS transistors 321 and 322, a differential pair 323 and 324 comprising P-channel MOS transistors of the same size, and a constant-current circuit 325. More specifically, the second analog buffer circuit 14 includes P-channel MOS transistors 323, 324, which constitute a differential pair, in which the sources thereof are tied together and connected to one end of the constant-current source 325 and the gates thereof are connected to input terminal 1 (Vin) and output terminal 2 (Vout), respectively; an N-channel MOS transistor 321 (which forms the transistor on the current-output side of the current mirror) having a source connected to the low-potential power supply VSS, a gate connected to the gate of the N-channel MOS transistor 322 and a drain connected to the drain of the P-channel MOS transistor 323; an N-channel MOS transistor 322 (which forms the transistor on the current-input side of the current mirror) having a source connected to the low-potential power supply VSS, and a gate and drain tied together and connected to the drain of the P-channel MOS transistor 324; and a switch 521 connected between the other end of the constant-current source 315 and the high-potential power supply VDD. The P-channel MOS transistors 323 and 324 forming the differential pair are of the same size. The drain of the P-channel MOS transistor 323 serves as the output terminal.

The output stage includes an N-channel MOS transistor 326 having a drain connected to the output terminal 2, a gate to which the output voltage of the differential circuit (the drain voltage of the P-channel MOS transistor 323) is input, and a source connected to the low-potential power supply VSS; and a current source 327 and switch 522 connected between the output terminal 2 and the high-potential power supply VDD. It should be noted that the N-channel MOS transistor 326 may be replaced by a P-channel MOS transistor having a booster circuit connected to the drain thereof. It should be noted that a phase compensating capacitor for stabilizing the output might be provided between the output terminal of the differential circuit and the output terminal 2.

Switches 521 and 522 have control terminals connected to control signals so as to be turned on and off. When these switches are off, current is cut off and operation of the circuit ceases. The switches may be placed at positions different from those shown in FIG. 19 so long as they can cut off the flow of current.

The precharging means 15 pre-charges the output terminal 2 when low-potential data is output and preliminarily discharges the output terminal 2 when high-potential data output. Preferably, the precharging voltage and pre-discharging voltage of the precharging means 15 are set to the vicinity of the drive changeover voltage Vc provided within a voltage range in which both the first analog buffer circuit 13 and second analog buffer circuit 14 are capable of operating. If this is done, the first analog buffer circuit 13 will perform drive based upon the charging operation and the second analog buffer circuit 14 will perform drive based upon the discharging operation and both buffer circuits can operate at high speed.

FIG. 20 is a diagram showing an example in which the first and second analog buffer circuits 13 and 14 having the structure of FIG. 19 are applied in the arrangement of FIG. 7. The structure and operation of the first and second analog buffer circuits 13 and 14 are the same as described above with reference to FIG. 19 and need not be described again.

FIG. 21 is a diagram showing yet another example of the structure of the first and second analog buffer circuits 13 and 14 in the embodiment illustrated in FIG. 1.

As shown in FIG. 21, the first analog buffer circuit 13 is composed of a voltage-follower differential amplifier circuit 310 having a differential stage and an output stage, and source-follower discharging means 410. The second analog buffer circuit 14 is composed of a voltage-follower differential amplifier circuit 320 having a differential stage and an output stage, and source-follower charging means 420.

The voltage-follower differential amplifier circuit 310 of first analog buffer circuit 13 comprises a constant-current source 315, a switch 511, N-channel MOS transistors 313 and 314 constituting a differential pair, current-mirror circuits 311 and 312, and a P-channel MOS transistor 316 having a gate that receives the output voltage of the differential pair. The source of the P-channel MOS transistor 316 is connected to the high-potential power supply VDD and the drain thereof is connected to the output terminal 2. The gates of the N-channel MOS transistors 313 and 314 constituting the differential pair are connected to the input terminal 1 and output terminal 2, respectively. The differential circuit basically has a structure the same as that of the differential circuit in the buffer circuit of FIG. 19 (though the constant-current source 317 and switch 512 for the discharging operation are not provided).

The source-follower discharging means 410 includes a constant-current source 413 and switch 551 connected serially between the input terminal 1 and high-potential power supply VDD; a P-channel MOS transistor 411 having a source connected to the input terminal 1 and having a gate and drain that are tied together; a constant-current source 414 and switch 552 connected serially between the drain of the P-channel MOS transistor 411 and the low-potential power supply VSS; a constant-current source 415 and switch 554 connected serially between the output terminal 2 and the high-potential power supply VOD; and a P-channel MOS transistor 412 having a gate connected in common with the gate of the P-channel MOS transi 411, and a drain connected to the low-potential power supply VSS via a switch 553.

The voltage-follower differential amplifier circuit 320 of second analog buffer circuit 14 comprises a constant-current source 325, a switch 521, P-channel MOS transistors 323 and 324 constituting a differential pair, current-mirror circuits 321 and 322, and an N-channel MOS transistor 326 having a gate that receives the output voltage of the differential pair. The source of the N-channel MOS transistor 326 is connected to the low-potential power supply VSS and the drain thereof is connected to the output terminal 2. The gates of the P-channel MOS transistors 323 and 324 constituting the differential pair are connected to the input terminal 1 and output terminal 2, respectively. The differential circuit basically has a structure the same as that of the differential circuit in the buffer circuit of FIG. 19 (though the constant-current source 327 and switch 522 for the charging operation are not provided).

The source-follower charging means 420 includes a constant-current source 423 and switch 561 connected serially between the input terminal I and low-potential power supply VSS, an N-channel MOS transistor 421 having a source connected to the input terminal 1 and having a gate and drain that are tied together; a constant-current source 424 and switch 562 connected serially between the drain of the N-channel MOS transistor 421 and the high-potential power supply VDD; a constant-current source 425 and switch 564 connected serially between the output terminal 2 and the low-potential power supply VSS; and an N-channel MOS transistor 422 having a gate connected in common with the gate of the N-channel MOS transistor 421, and a drain connected to the high-potential power supply VDD via a switch 563.

By combining a source follower circuit having a function for stabilizing the output voltage with a voltage follower circuit (differential amplifier circuit) in this embodiment, phase compensating means (a phase compensating capacitor) can be dispensed with and high-speed operation becomes possible with little consumption of power.

The first analog buffer circuit 13 includes the voltage-follower differential amplifier circuit 310, which is capable of pulling up the output voltage Vout by producing a charging effect owing to the two inputs of the input signal voltage Vin and output voltage Vout, and the source-follower discharging means 410 which, through an operation independent of that of the differential amplifier 310, produces a discharging effect based upon the source-follower operation of the transistors in dependence upon the voltage difference between the input signal voltage Vin and output voltage Vout.

The differential amplifier circuit 310 has a differential stage that operates in accordance with the voltage difference between the two inputs of the input signal voltage Vin and output voltage Vout, and charging means (transistor 316) that produces a discharging effect in accordance with the output of the differential stage. The differential amplifier circuit 310 operates in accordance with the voltage difference between Vin and Vout. If the voltage output Vout is lower than the voltage Vin, the differential amplifier circuit 310 pulls the output voltage Vout up to the voltage Vin by a charging operation.

The differential amplifier circuit 310 is capable of operating at high speed because it does not have phase compensating means. In a feedback-type arrangement, however, there is a slight response delay until the change in the output voltage Vout is reflected in the charging operation. The delay is ascribable to parasitic capacitance, etc., of the circuit elements. As a consequence, there are instances where overshoot (excessive charging) occurs.

On the other hand, the source-follower discharging means 410 has a discharge capability conforming to the voltage difference between input signal voltage Vin and output voltage Vout. If the output voltage Vout is greater than the input signal voltage Vin, the source-follower discharging means 410 pulls the output voltage Vout down to the voltage Vin owing to the discharge effect produced by source-follower operation of the transistor 412.

When voltage difference between the input signal voltage Vin and output voltage Vout is large, the discharging capability of the source-follower discharging means 410 is high. As the voltage difference declines, so does the discharging capability of the discharging means. As a consequence, the change in the output voltage Vout due to the discharging operation becomes gentler as the output voltage Vout comes up to the voltage Vin. The source-follower discharging means 410 therefore causes the output voltage Vout to change rapidly to the voltage Vin and causes the voltage to stabilize at the voltage Vin In other words, if the output voltage Vout is lower than the input voltage Vin, the output voltage Vout is pulled up to the voltage Vin rapidly by the differential amplifier circuit 310. Even if overshoot (excessive charging) occurs at this time, the voltage is pulled down to the voltage Vin rapidly by the source-follower discharging means 410, as a result of which a stable output is obtained.

On the other hand, if the output voltage Vout is higher than the desired voltage, the output voltage Vout is pulled down to the voltage Vin by the source-follower discharging means 410 owing to the source-follower discharging operation that conforms to the voltage difference between Vin and Vout, without the differential amplifier circuit 310 operating. As a result, a stable output is obtained.

Further, the voltage-follower differential amplifier circuit 310 does not possess a phase compensating capacitor and, hence, there is only a slight response delay ascribable to parasitic capacitance, etc., of the circuit elements. Even if overshoot occurs, therefore, it is held to a sufficiently low level. This makes it easy to stabilize the output voltage. Furthermore, because the differential amplifier circuit 310 does not have a phase compensating capacitor, a current for charging/discharging the phase compensating capacitor is unnecessary. This makes it possible to suppress the consumption of current and to lower power consumption.

Thus, by combining the differential amplifier circuit 310 and the source-follower discharging means 410, the output voltage Vout can be stabilized rapidly at a voltage equal to the input signal voltage Vin in concurrence with high-speed charging when charging is performed.

The second analog buffer Circuit 14 includes the voltage-follower differential amplifier circuit 320, which is capable of pulling down the output voltage Vout by producing a discharging effect owing to the two inputs of the input signal voltage Vin and output voltage Vout, and the source-follower charging means 420 which, through an operation independent of that of the differential amplifier 320, produces a charging effect based upon the source-follower operation of the transistors in dependence upon the voltage difference between the input signal voltage Vin and output voltage Vout.

The differential amplifier circuit 320 has a differential stage that operates in accordance with the voltage difference between the two inputs of the input signal voltage Vin and output voltage Vout, and discharging means (transistor 326) that produces a discharging effect in accordance with the output of the differential stage. The differential amplifier circuit 320 operates in accordance with the voltage difference between Vin and Vout. If the output voltage Vout is higher than the voltage Vin, the differential amplifier circuit 320 pulls the output voltage Vout down to the voltage Vin by a discharging operation.

The differential amplifier circuit 320 is capable of operating at high speed because it does not have phase compensating means. In a feedback-type arrangement, however, there is a slight response delay until the change in the output voltage Vout is reflected in the charging operation. The delay is ascribable to parasitic capacitance, etc., of the circuit elements. As a consequence, there are instances where undershoot (excessive discharging) occurs, On the other hand, the source-follower charging means 420 has a charging capability conforming to the voltage difference between input signal voltage Vin and output voltage Vout. If the output voltage Vout is less than the input signal voltage Vin, the source-follower charging means 420 pulls the output voltage Vout up to the voltage Vin owing to the charging effect produced by source-follower operation of the transistor 422.

When voltage difference between the input signal voltage Vin and output voltage Vout is large, the charging capability of the source-follower charging means 420 is high. As the voltage difference declines, so does the charging capability of the charging means. As a consequence, the change in the output voltage Vout due to the charging operation becomes gentler as the voltage Vin is approached. The source-follower charging means 420 therefore causes the output voltage Vout to change rapidly to the voltage Vin and causes the voltage to stabilize at the voltage Vin.

In other words, if the output voltage Vout is higher than the input voltage Vin, the output voltage Vout is pulled down to the voltage Vin rapidly by the differential amplifier circuit 320. Even if undershoot (excessive discharging) occurs at this time, the voltage is pulled up to the voltage Vin rapidly by the source-follower charging means 420, as a result of which a stable output is obtained.

On the other hand, if the output voltage Vout is lower than the voltage Vin, the output voltage Vout is pulled up to the voltage Vin by the source-follower charging means 420 owing to the source-follower charging operation that conforms to the voltage difference between Vin and Vout, without the differential amplifier circuit 320 operating As a result, a stable output is obtained.

Further, the voltage-follower differential amplifier circuit 320 does not possess a phase compensating capacitor and, hence, there is only a slight response delay ascribable to parasitic capacitance, etc., of the circuit elements. Even if undershoot occurs, therefore, it is held to a sufficiently low level. This makes it easy to stabilize the output voltage. Furthermore, because the differential amplifier circuit 320 does not have a phase compensating capacitor, a current for charging/discharging the phase compensating capacitor is unnecessary. This makes it possible to suppress the consumption of current and to lower power consumption.

Thus, by combining the differential amplifier circuit 320 and the source-follower charging means 420, the output voltage Vout can be stabilized rapidly at a voltage equal to the input signal voltage Vin in concurrence with high-speed discharging when discharging is performed.

Further, the driver circuit shown in FIG. 21 may be provided with precharging means for precharging the output terminal 2 when low-potential data is output and preliminarily discharging the output terminal 2 when high-potential data output. Preferably, the precharging voltage and pre-discharging voltage of the precharging means are set to the vicinity of the drive changeover voltage Vc provided within a voltage range in which both the first analog buffer circuit 13 and second analog buffer circuit 14 arc capable of operating. If this is done, the first analog buffer circuit 13 will perform drive based upon the charging operation and the second analog buffer circuit 14 will perform drive based upon the discharging operation and both buffer circuits can operate at high speed.

FIG. 22 is a diagram showing an example in which the first and second analog buffer circuits 13, 14 having the structure of FIG. 21 are applied in the embodiment of FIG. 7.

Figure 23A:
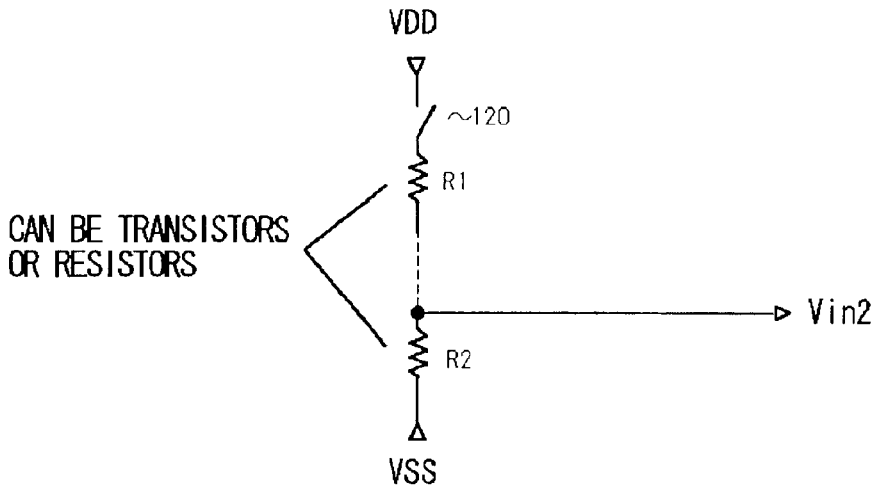
FIGS. 23A and 23B are diagrams illustrating an example of the structure of reference voltage generating means in the driver circuit according to the embodiment shown in FIG. 7.
Figure 23B:
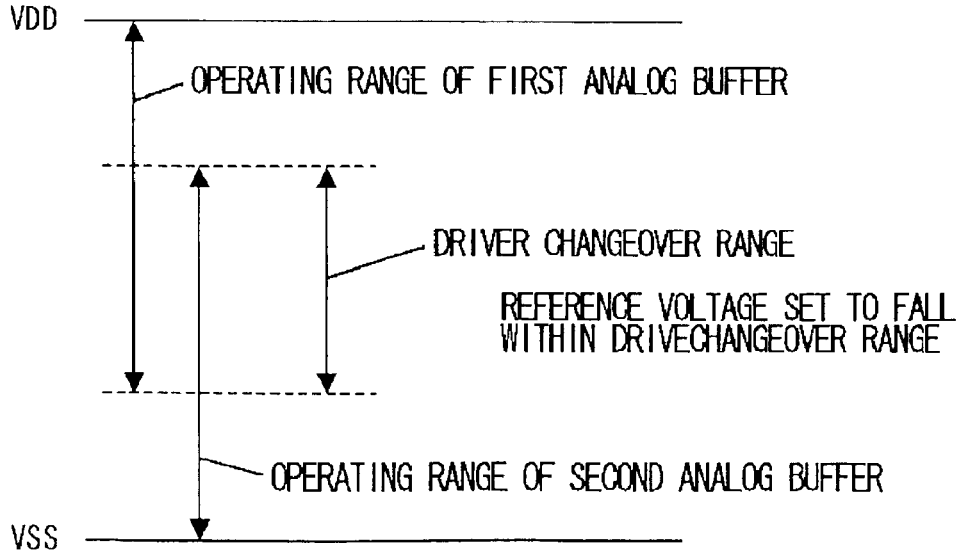
Figure 24:
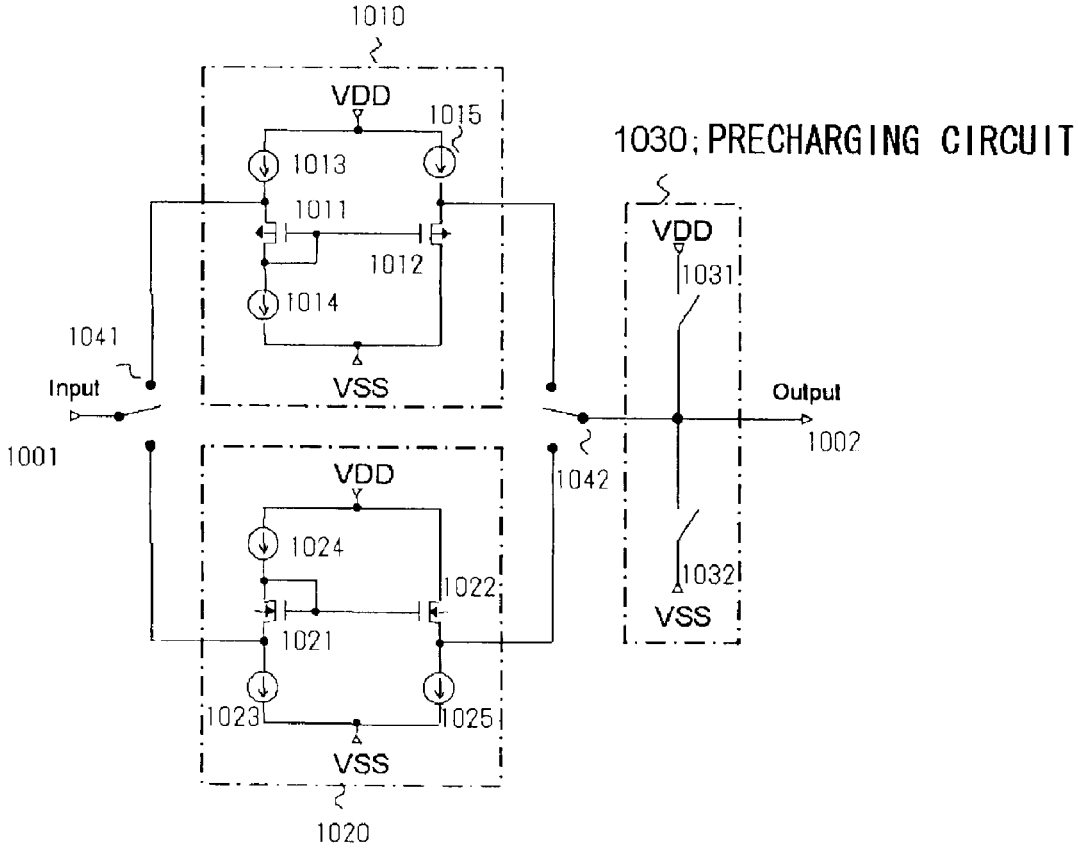
FIG. 24 is a diagram showing the structure of a buffer described in the reference "A New Low-Power Driver for Portable Devices," by H. Tsuchis, N. Ikeda and H. Hayama. SID 00 DIGEST pp. 146–149.
Figure 25:
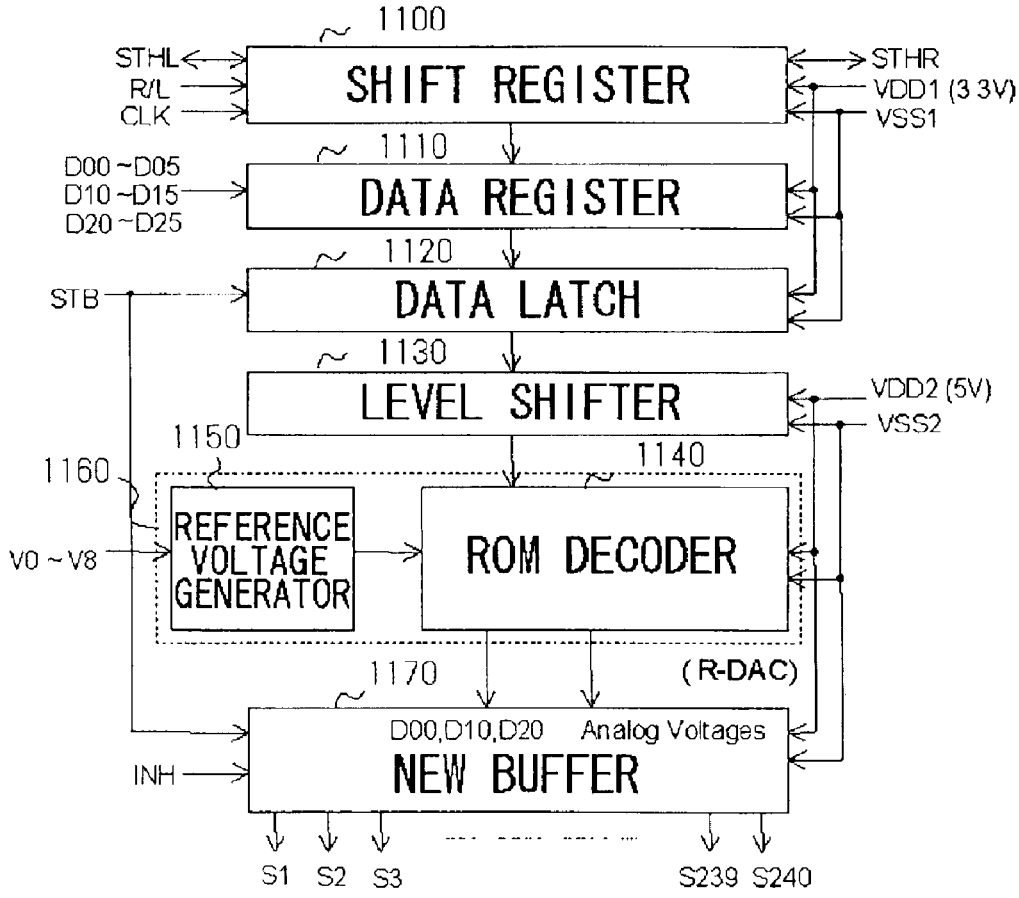
FIG. 25 is a diagram showing the structure of a digital-data line driver described in the reference mentioned in FIG. 24.

FIG. 23A is a diagram schematically illustrating the structure of the reference voltage generating means 11 in the embodiment of FIG. 7. A switch 120 and potential-dividing resistors R1 and R2 are connected between VDD and VSS so that a potential-divided value Vin2 is output. The voltage (reference voltage) Vin2 is made a voltage within a drive changeover range corresponding to overlap between the operating ranges of the first and second analog buffer circuits 13, and 14, as shown in FIG. 23B. The resistors R1 and R2 may of course be constructed using active elements such as transistors or diodes.

It goes without saying that the circuits of the above-described embodiments may be combined to realize the circuit arrangements of the analog buffer circuits 13 and 14 described above with reference to the drawings. Further, application of the driver circuit according to the present invention is not limited to a data-line driver of a liquid crystal display device. That is, it is possible to adopt an arrangement in which the changeover between two buffer circuits on the side of high and low potentials is performed reliably in a voltage range within which both of the buffer circuits operate, thereby realizing a highly precise, full-range voltage output. This can be applied a highly precise voltage-output buffer circuit having any application Though the present invention has been described in accordance with the foregoing embodiments, the invention is not limited to these embodiments and it goes without saying that the invention covers various modifications and changes that would be obvious to those skilled in the art within the scope of the claims. In particular, in the embodiments set forth above, a description relating to two polarities is rendered as an example of an arrangement ideal for a data-line driver circuit in an active matrix liquid crystal display device. It goes without saying that in case of application to the data-line driver circuit of an active-matrix organic EL display device that does not require switching of polarities, application is facilitated by adopting only one of the two polarities as the active polarity and treating the other polarity as an inactive polarity Furthermore, the inactive portions of the circuitry may be eliminated.

The meritorious effects of the present invention are summarized as follows.

Thus, in accordance with the driver circuit according to the present invention, changeover between first and second buffer circuits can be performed in a voltage range within which both buffer circuits can operate, irrespective of the type of modulation when display element characteristics are modulated. The occurrence of phenomena such as tone jump can be avoided in a case where a driver circuit is used for driving the data lines in an active-matrix display device.

As many apparently widely different embodiments of the present invention can be made without departing from the spirit and scope thereof, it is to be understood that the invention is not limited to the specific embodiments thereof except as defined in the appended claims It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items might fall under the modifications aforementioned,

What is claimed is:

1. A driver circuit for driving an output load, comprising:

first and second buffer circuits having respective ones of input terminals connected in common with one input terminal provided for receiving an input signal voltage and respective ones of output terminals connected in common with an output terminal, said first buffer circuit having an operating range at least on the side of a high potential and said second buffer circuit having an operating range at least on the side of a low potential;

a storage unit for storing reference data, which is for selecting changeover between operation of said first buffer circuit and operation of said second buffer circuit;

a comparator for comparing an entered data signal and the reference data; and means for controlling switching of said first buffer circuit and said second buffer circuit between activation and deactivation thereof within a range in which both of said buffer circuits are capable of operating, based upon an output signal of said comparator, which indicates result of the comparison, and a control signal.

2. The driver circuit according to claim 1, wherein the reference data corresponds to a voltage within the range in which both of said first and second buffer circuits are capable of operating.

3. A driver circuit comprising:

first and second buffer circuits having respective ones of input terminals connected in common with one input terminal which receives an input signal voltage and respective ones of output terminals connected in common with an output terminal, said first buffer circuit having an operating range that extends to a high-potential power supply voltage and said second buffer circuit having an operating range that extends to a low-potential power supply voltage;

a storage unit for storing, in association with a relationship between entered digital data and signal voltage, reference data of first and second polarities, which is for determining changeover between operation of said first buffer circuit and operation of said second buffer circuit, with regard to each of first and second polarities that define a characteristic from a predetermined reference voltage signal;

a selector, which receives a polarity signal specifying polarity, for selecting the reference data of the first or second polarity based upon the value of the polarity signal;

a comparator for comparing entered digital data and the reference data output from said selector; and means for controlling switching of said first buffer circuit and said second buffer circuit between activation and deactivation thereof within a range in which both of said buffer circuits are capable of operating, based upon an output signal of said comparator, which indicates result of the comparison, and a control signal.

4. The circuit according to claim 3, wherein the reference data of the first or second polarity corresponds to a voltage within the range in which both of said first and second buffer circuits are capable of operating.

5. A driver circuit comprising:

first and second buffer circuits having respective ones of input terminals connected in common with one input terminal provided for receiving an input signal voltage and respective ones of output terminals connected in common with an output terminal, said first buffer circuit having an operating range that extends to a high-potential power supply voltage and said second buffer circuit having an operating range that extends to a low-potential power supply voltage;

a storage unit for storing reference data, which corresponds to an input signal voltage within a range in which both of said first and second buffer circuits are capable of operating, with regard to each of a standard state and modulated state of a characteristic relating to grayscale level and signal voltage;

a selector for selectively outputting reference data corresponding to the standard state or modulated state based upon modulation information that specifies modulation;

a comparator for comparing entered data and the reference data output from said selector; and means for controlling activation and deactivation of said first buffer circuit and said second buffer circuit based upon an output signal of said comparator, which indicates result of the comparison, and a control signal.

6. The driver circuit according to claim 5, wherein said storage unit stores a plurality of items of reference data defined in accordance with type of modulation; and said selector selectively outputs reference data, which conforms to type of modulation, based upon entered modulation information.

7. A driver circuit comprising:

first and second buffer circuits having respective ones of input terminals connected in common with one input terminal provided for receiving an input signal voltage and respective ones of output terminals connected in common with an output terminal, said first buffer circuit having an operating range that extends to a high-potential power supply voltage and said second buffer circuit having an operating range that extends to a low-potential power supply voltage;

a first storage unit for storing positive-polarity reference data, which corresponds to a signal voltage within a range in which both of said first and second buffer circuits are capable of operating, with regard to each of a standard state and modulated state of a characteristic relating to grayscale level and signal voltage;

a second storage unit for storing negative-polarity reference data, which corresponds to a signal voltage within a range in which both of said first and second buffer circuits are capable of operating, with regard to each of a standard state and modulated state of a characteristic relating to grayscale level and signal voltage;

a selector for selecting one of said first and second storage units, on the basis of a polarity signal specifying polarity, and selectively outputting reference data corresponding to the standard state or modulated state based upon modulation information that specifies modulation;

a comparator for comparing entered data and the reference data output from said selector; and means for controlling switching of said first buffer circuit and said second buffer circuit between activation and deactivation thereof based upon an output signal of said comparator, which indicates result of the comparison, and a control signal.

8. The driver circuit according to claim 7, wherein said first storage unit stores a plurality of items of positive-polarity reference data defined in accordance with type of modulation;

said second storage unit stores a plurality of items of negative-polarity reference data defined in accordance with type of modulation; and said selector selects one of said first and second storage units, on the basis of the polarity signal, and selectively outputs reference data corresponding to the type of modulation based upon entered modulation information.

9. The driver circuit according to claim 1, wherein said first buffer circuit is activated and said second buffer circuit is deactivated if, when the control signal takes on a value specifying activation, the output signal of said comparator takes on a value indicating that an electric potential associated with the entered data is equal to or greater than an electric potential associated with the reference data; and said second buffer circuit is activated and said first buffer circuit is deactivated if, when the control signal takes on a value specifying activation, the output signal of said comparator takes on a value indicating that an electric potential associated with the entered data is less than an electric potential associated with the reference data.

10. The driver circuit according to claim 7, wherein the polarity signal is a logic value indicating polarity, in inversion drive, of a common potential (Vcom) of opposing electrodes in a liquid crystal display device.

11. The driver circuit according to claim 7, wherein at least one of said first storage unit, said second storage unit and said selector are provided externally of said driver circuit and are connected electrically thereto.

12. A driver circuit comprising:

grayscale-level voltage generating means, which has a plurality of resistors connected serially between first and second reference voltages, for generating grayscale-level voltages from taps thereof; and a decoder circuit, which receives a digital data signal, for selectively outputting a corresponding voltage from output voltages of said grayscale-level voltage generating means;

wherein a plurality of the driver circuits set forth in claim 3 are provided, said driver circuits receiving the output of said decoder circuit for driving an output load; and at least said storage unit and said selector are shared by a prescribed number of said driver circuits.

13. A driver circuit for driving an output load, comprising:

first and second buffer circuits having respective ones of input terminals connected in common with one input terminal provided for receiving an input signal voltage and respective ones of output terminals connected in common with an output terminal, said first buffer circuit having an operating range at least on the side of a high potential and said second buffer circuit having an operating range at least on the side of a low potential;

reference voltage generating means for generating a reference voltage corresponding to a voltage range in which both said first buffer circuit and said second buffer circuit are capable of operating;

a comparator for comparing the reference voltage, which is output from said reference voltage generating means, and the input signal voltage; and means for controlling switching of said first buffer circuit and said second buffer circuit between activation and deactivation thereof within a range in which both of said buffer circuits are capable of operating, based upon an output signal of said comparator, which indicates result of the comparison, and a control signal.

14. The driver circuit according to claim 13, wherein said first buffer circuit is activated and said second buffer circuit is deactivated if, when the control signal takes on a value specifying activation, the output signal of said comparator takes on a value indicating that the entered input signal voltage is equal to or greater than the reference voltage; and said second buffer circuit is activated and said first buffer circuit is deactivated if, when the control signal takes on a value specifying activation, the output signal of said comparator takes on a value indicating that the entered input signal voltage is less than the reference voltage.

15. A driver circuit comprising:

first and second buffer circuits having respective ones of input terminals connected in common with one input terminal provided for receiving an input signal voltage and respective ones of output terminals connected in common with an output terminal, said first buffer circuit having an operating range that extends to a high-potential power supply voltage and said second buffer circuit having an operating range that extends to a low-potential power supply voltage;

reference voltage generating means for generating a reference voltage of a voltage range in which both said first buffer circuit and said second buffer circuit are capable of operating;

a comparator for comparing the reference voltage, which is output from said reference voltage generating means, and the input signal voltage;

a first logic circuit, which receives the output signal of said comparator and the control signal, for outputting result of a logical operation upon the comparator output signal to said first buffer circuit when the control signal is active; and a second logic circuit, which receives a signal that is the inverse of the output signal of said comparator and the control signal, for outputting result of a logical operation upon the signal that is the inverse of the comparator output signal to said second buffer circuit when the control signal is active.

16. The driver circuit according to claim 15, wherein said reference voltage generating means is provided externally of said driver circuit.

17. A driver circuit comprising:

grayscale-level voltage generating means, which has a plurality of resistors connected serially between first and second reference voltages, for generating grayscale-level voltages from taps thereof; and a decoder circuit, which receives a digital data signal, for selectively outputting a corresponding voltage from output voltages of said grayscale-level voltage generating means;

wherein a plurality of the driver circuits set forth in claim 13 are provided, said driver circuits receiving the output of said decoder circuit for driving an output load; and at least one of said reference voltage generating means is shared by a prescribed number of said driver circuits.

18. The driver circuit according to claim 13, wherein said comparator includes:

a differential amplifier circuit receiving the input signal voltage and the reference voltage differentially; and a holding circuit connected to an output from said differential amplifier circuit via a switch.

19. The driver circuit according to claim 13, wherein said comparator includes:

a differential amplifier circuit receiving the input signal voltage and the reference voltage differentially; and a flip-flop circuit connected to one output terminal of said differential amplifier circuit via a first switch;

said flip-flop circuit including:

a first inverter having an input terminal connected to said first switch;

a second inverter having an input terminal connected to an output terminal of the first inverter and a second switch connected between the output terminal of said second inverter and the input terminal of said first inverter;

wherein an output signal of said second inverter is delivered as the output signal of said comparator; and control is carried out in such a manner that when said differential amplifier circuit operates, said first switch is turned on and the output of said differential amplifier circuit is received and latched by said flip-flop circuit, at which time said first switch is turned off and said second switch is turned on.

20. The driver circuit according to claim 13, wherein said comparator includes:

a differential amplifier circuit receiving the input signal voltage and the reference voltage differentially; and a flip-flop circuit;

said differential amplifier circuit including:

a differential pair receiving the input signal voltage and the reference voltage differentially;

a first switch inserted into a power supply path of a current source that drives said differential pair;

an output-stage transistor for receiving an output of said differential pair; and a second switch inserted into a power supply path of said output-stage transistor;

said flip-flop circuit including:

a first inverter having an input terminal connected to an output terminal of said output-stage transistor via a third switch;

a second inverter having an input terminal connected to an output terminal of the first inverter, and a fourth switch connected between the output terminal of said second inverter and the input terminal of said first inverter;

a signal from an output terminal of said second inverter and/or a signal from an output terminal of said first inverter being output as the output signal of said comparator;

control being carried out in such a manner that when said differential amplifier circuit operates, all of said first, second and third switches are turned on and the output of said differential amplifier circuit is received and latched by said flip-flop circuit, at which time said first, second and third switches are turned off and said fourth switch is turned on.

21. The driver circuit according to claim 13, wherein said comparator includes:

a differential amplifier circuit receiving the input signal voltage and the reference voltage differentially; and a flip-flop circuit;

said differential amplifier circuit including:

a differential pair receiving the input signal voltage and the reference voltage differentially;

a first switch inserted into a power supply path of a current source that drives said differential pair;

an output-stage transistor for receiving an output of said differential pair; and a second switch inserted into a power supply path of said output-stage transistor;

said flip-flop circuit including:

a first clocked inverter connected to an output terminal of said output-stage transistor via a third switch; and a second clocked inverter having an input terminal connected to an output terminal of said first clocked inverter;

an output terminal of said second clocked inverter being connected to an input terminal of said first clocked inverter;

a signal from an output terminal of said second clocked inverter and/or a signal from an output terminal of said first clocked inverter being output as the output signal of said comparator;

control being carried out in such a manner that when said differential amplifier circuit operates, all of said first, second and third switches are turned on and the output of said differential amplifier circuit is received and latched by said flip-flop circuit, at which time said first, second and third switches are turned off.

22. The driver circuit according to claim 13, wherein said comparator includes:

a differential amplifier circuit receiving the input signal voltage and the reference voltage differentially; and a flip-flop circuit;

said differential amplifier circuit including:

a differential pair to which the input signal voltage and the reference voltage are differentially input;

a first switch inserted into a power supply path of a current source that drives said differential pair;

an output-stage transistor for receiving an output of said differential pair; and a second switch inserted into a power supply path of said output-stage transistor;

said flip-flop circuit including:

a first clocked inverter having an input terminal connected to an output terminal of said output-stage transistor via a third switch, said first clocked inverter including a fourth switch connected between a source of a P-channel MOS transistor, which constructs a CMOS inverter, and the high-potential power supply, and a fifth switch connected between a source of an N-channel MOS transistor, which constructs said CMOS inverter, and the low-potential power supply; and a second clocked inverter having an input terminal connected to an output terminal of said first clocked inverter, said second clocked inverter including a sixth switch connected between a source of a P-channel MOS transistor, which constructs a CMOS inverter, and the high-potential power supply, and a seventh switch connected between a source of an N-channel MOS transistor, which constructs said CMOS inverter, and the low-potential power supply;

an output terminal of said second clocked inverter being connected to an input terminal of said first clocked inverter;

a signal from an output terminal of said second clocked inverter, and/or signals from output terminal of said first and second clocked inverters, being output as the output signal of said comparator; and when said differential amplifier circuit operates, said first, second and third switches are turned on and the output of said differential amplifier circuit is received and latched by said flip-flop circuit, at which time said first, second and third switches are turned off and said fourth, fifth, sixth and seventh switches are turned on.

23. The driver circuit according to claim 21, wherein a capacitance value of a load capacitance at the output terminal of said second clocked inverter is made larger than a capacitance value of a load capacitance at the output terminal of said first clocked inverter.

24. The driver circuit according to claim 1, wherein said first buffer circuit includes:

a source-follower transistor connected between the low-potential power supply and the output terminal;

first gate bias control means, which receives the input signal voltage, for supplying said source-follower transistor with a gate bias voltage; and means for precharging the output terminal.

25. The driver circuit according to claim 1, wherein said second buffer circuit includes:

a source-follower transistor connected between the high-potential power supply and the output terminal;

second gate bias control means, which receives the input signal voltage, for supplying said source-follower transistor with a gate bias voltage; and means for pre-discharging the output terminal.

26. The driver circuit according to claim 1, wherein said first buffer circuit includes:

a source-follower first transistor connected between the low-potential power supply and the output terminal;

first gate bias control means, which receives the input signal voltage, for supplying said source-follower first transistor with a first gate bias voltage; and means for precharging the output terminal; and said second buffer circuit includes:

a source-follower second transistor connected between the high-potential power supply and the output terminal;

second gate bias control means, which receives the input signal voltage, for supplying said source-follower second transistor with a second gate bias voltage; and means for pre-discharging the output terminal.

27. The driver circuit according to claim 1, wherein said first buffer circuit includes:

a first current source and a first switch connected serially between the input terminal and the high-potential power supply;

a first MOS transistor of a first conductivity type having a source connected to the input terminal and a gate and drain connected to each other;

a second current source and a second switch connected serially between the output terminal and the low-potential power supply;

a third current source and a third switch connected serially between the drain of said first MOS transistor and the high-potential power supply; and a second MOS transistor of the first conductivity type having a source connected to the output terminal, a gate connected in common with the gate of said first MOS transistor, and a drain connected to the low-potential power supply via a fourth switch;

a fifth switch for controlling charging of the output terminal, said fifth switch being provided between the output terminal and the high-potential power supply.

28. The driver circuit according to claim 1, wherein said second buffer circuit includes:

a fourth current source and a sixth switch connected serially between the input terminal and the low-potential power supply;

a third MOS transistor of a second conductivity type having a source connected to the input terminal and a gate and drain connected to each other;

a fifth current source and a seventh switch connected serially between the drain of said third MOS transistor and the high-potential power supply;

a sixth current source and an eighth switch connected serially between the output terminal and the low-potential power supply; and a fourth MOS transistor of the second conductivity type having a source connected to the output terminal, a gate connected in common with the gate of said third MOS transistor, and a drain connected to the high-potential power supply via a ninth switch;

a tenth switch for controlling discharging of the output terminal, said tenth switch being provided between the output terminal and the low-potential power supply.

29. The driver circuit according to claim 1, wherein said first buffer circuit includes:

a first current source and a first switch connected serially between the input terminal and the high-potential power supply;

a first MOS transistor of a first conductivity type having a source connected to the input terminal and a gate and drain connected to each other;

a second current source and a second switch connected serially between the drain of said first MOS transistor and the low-potential power supply;

a third current source and a third switch connected serially between the output terminal and the high-potential power supply; and a second MOS transistor of the first conductivity type having a source connected to the output terminal, a gate connected in common with the gate of said first MOS transistor, and a drain connected to the low-potential power supply via a fourth switch;

a fifth switch for controlling charging of the output terminal, said fifth switch being provided between the output terminal and the high-potential power supply; and said second buffer circuit includes:

a fourth current source and a sixth switch connected serially between the input terminal and the low-potential power supply;

a third MOS transistor of a second conductivity type having a source connected to the input terminal and a gate and drain connected to each other;

a fifth current source and a seventh switch connected serially between the drain of said third MOS transistor and the high-potential power supply;

a sixth current source and an eighth switch connected serially between the output terminal and the low-potential power supply; and a fourth MOS transistor of the second conductivity type having a source connected to the output terminal, a gate connected in common with the gate of said third MOS transistor, and a drain connected to the high-potential power supply via a ninth switch;

a tenth switch for controlling discharging of the output terminal, said tenth switch being provided between the output terminal and the low-potential power supply.

30. The driver circuit according to claim 1, wherein said first buffer circuit includes a voltage follower circuit comprising a differential amplifier circuit which has includes a differential pair comprising a pair of MOS transistors of a second conductivity type, said differential amplifier circuit including a non-inverting input terminal to which the input terminal is connected and an inverting input terminal to which the output terminal is connected.

31. The driver circuit according to claim 1, wherein said second buffer circuit includes a voltage follow circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected.

32. The driver circuit according to claim 1, wherein said first buffer circuit includes a first voltage follower circuit comprising a differential amplifier circuit which includes a differential pair comprising a pair of MOS transistors of a second conductivity type, said differential amplifier circuit including a non-inverting input terminal to which the input terminal is connected and an inverting input terminal to which the output terminal is connected; and said second buffer circuit includes a second voltage follower circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected.

33. The driver circuit according to claim 30, further comprising means for precharging and pre-discharging the output terminal.

34. The driver circuit according to claim 1, wherein said first buffer circuit comprises:

a differential stage having:

a differential pair comprising a pair of MOS transistors of a second conductivity type;

a load circuit connected between an output pair of said differential pair and the high-potential power supply;

a current source for driving said differential pair; and a first switch for controlling the opening and closing of a current path between said current source and the low-potential power supply;

a MOS transistor, which receives one output of said differential pair, having an output connected to the output terminal; and a current source and a switch connected between the output terminal and the low-potential power supply;

the input terminal and the output terminal being connected to gates of respective ones of the pair of MOS transistors of said differential pair.

35. The driver circuit according to claim 1, wherein said second buffer circuit comprises:

a differential stage having:

a differential pair comprising a pair of MOS transistors of a first conductivity type;

a load circuit connected between an output pair of said differential pair and the low-potential power supply;

a current source for driving said differential pair; and a switch for controlling the opening and closing of a current path between said current source and the high-potential power supply;

a MOS transistor, to which one output of said differential pair is input, having an output connected to the output terminal; and a current source and a switch connected between the output terminal and the high-potential power supply;

the input terminal and the output terminal being respectively connected to gates of the pair of MOS transistors of said differential pair.

36. The driver circuit according to claim 1, wherein said first buffer circuit comprises:

a first differential stage having:

a first differential pair comprising first and second MOS transistors of a second conductivity type;

a first load circuit connected between an output pair of said differential pair and the high-potential power supply;

a first current source for driving said first differential pair; and a first switch for controlling the opening and closing of a current path between said first current source and the low-potential power supply;

a third MOS transistor, to which one output of said first differential pair is input, having an output connected to the output terminal; and a second current source and a second switch connected between the output terminal and the low-potential power supply;

the input terminal and the output terminal being connected to gates of respective ones of the first and second MOS transistors of said first differential pair; and said second buffer circuit comprises:

a second differential stage having:

a second differential pair comprising fourth and fifth MOS transistors of a first conductivity type;

a second load circuit connected between an output pair of said differential pair and the low-potential power supply;

a third current source for driving said second differential pair; and a third switch for controlling the opening and closing of a current path between said third current source and the high-potential power supply;

a sixth MOS transistor, to which one output of said second differential pair is input, having an output connected to the output terminal; and a fourth current source and a fourth switch connected between the output terminal and the high-potential power supply;

the input terminal and the output terminal being connected to gates of respective ones of the fourth and fifth MOS transistors of said second differential pair.

37. The driver circuit according to claim 34, further comprising means for precharging and pre-discharging the output terminal.

38. The driver circuit according to claim 1, wherein said first buffer circuit comprises:

a voltage follower circuit comprising a differential amplifier circuit which includes a differential pair comprising a pair of MOS transistors of a second conductivity type, said differential amplifier circuit including a non-inverting input terminal to which the input terminal is connected and an inverting input terminal to which the output terminal is connected;

a source-follower transistor connected to the low-potential power supply and the output terminal; and first gate-bias control means, to which the input signal voltage is input, for supplying said source-follower transistor with a gate bias voltage.

39. The driver circuit according to claim 1, wherein said second buffer circuit comprises:

a voltage follower circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected;

a source-follower transistor connected to the high-potential power supply and the output terminal; and second gate-bias control means, to which the input signal voltage is input, for supplying said source-follower transistor with a gate bias voltage.

40. The driver circuit according to claim 1, wherein said first buffer circuit comprises:

a first voltage follower circuit comprising a differential amplifier circuit which includes a differential pair comprising a pair of MOS transistors of a second conductivity type, said differential amplifier circuit including a non-inverting input terminal to which the input terminal is connected and an inverting input terminal to which the output terminal is connected;

a source-follower first transistor connected to the low-potential power supply and the output terminal; and first gate-bias control means, to which the input signal voltage is input, for supplying said source-follower first transistor with a gate bias voltage; and said second buffer circuit comprises: a second voltage follower circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected;

a source-follower second transistor connected to the high-potential power supply and the output terminal; and second gate-bias control means, to which the input signal voltage is input, for supplying said source-follower transistor with a gate bias voltage.

41. The driver circuit according to claim 38, further comprising means for precharging and pre-discharging the output terminal.

42. The driver circuit according to claim 1, wherein said first buffer circuit comprises:

a differential stage having:

a differential pair comprising first and second MOS transistors of a second conductivity type;

an active load circuit connected between an output pair of said differential pair and the high-potential power supply;

a first current source for driving said differential pair; and a first switch for controlling the opening and closing of a current path between said first current source and the low-potential power supply;

a third MOS transistor, to which one output of said differential pair is input, having an output connected to the output terminal; the input terminal and the output terminal being connected to gates of respective ones of said first and second MOS transistors;

a second current source and a second switch connected serially between the input terminal and the high-potential power supply;

a fourth MOS transistor of a first conductivity type having a source connected to the input terminal and a gate and drain connected to each other;

a third current source and a third switch connected serially between the drain of said fourth MOS transistor and the low-potential power supply;

a fourth current source and a fourth switch connected serially between the output terminal and the high-potential power supply; and a fifth MOS transistor of a first conductivity type having a source connected to the output terminal, a gate connected in common with the gate of said fourth MOS transistor, and a drain connected to the low-potential power supply via a fifth switch.

43. The driver circuit according to claim 1, wherein said second buffer circuit comprises:

a differential stage having:

a differential pair comprising sixth and seventh MOS transistors of a first conductivity type;

an active load circuit connected between an output pair of said differential pair and the low-potential power supply;

a fifth current source for driving said differential pair; and a sixth switch for controlling the opening and closing of a current path between said fifth current source and the high-potential power supply;

an eighth MOS transistor, to which an output of said differential pair is input, having an output connected to the output terminal; the input terminal and the output terminal being connected to gates of respective ones of said sixth and seventh MOS transistors;

a sixth current source and a seventh switch connected serially between the input terminal and the low-potential power supply;

a ninth MOS transistor of a second conductivity type having a source connected to the input terminal and a gate and drain connected to each other;

a seventh current source and an eighth switch connected serially between the drain of said ninth MOS transistor and the high-potential power supply;

an eighth current source and a ninth switch connected serially between the output terminal and the low-potential power supply; and a tenth MOS transistor of a first conductivity type having a source connected to the output terminal, a gate connected in common with the gate of said ninth MOS transistor, and a drain connected to the high-potential power supply via a tenth switch.

44. The driver circuit according to claim 1, wherein said first buffer circuit comprises:

a first differential stage having:

a first differential pair comprising first and second MOS transistors of a second conductivity type;

an active load circuit connected between an output pair of said differential pair and the high-potential power supply;

a first current source for driving said differential pair; and a first switch for controlling the opening and closing of a current path between said first current source and the low-potential power supply;

a third MOS transistor, to which one output of said first differential pair is input, having an output connected to the output terminal; the input terminal and the output terminal being connected to gates of respective ones of said first and second MOS transistors;

a second current source and a second switch connected serially between the input terminal and the high-potential power supply;

a fourth MOS transistor of a first conductivity type having a source connected to the input terminal and a gate and drain connected to each other;

a third current source and a third switch connected serially between the drain of said fourth MOS transistor and the low-potential power supply;

a fourth current source and a fourth switch connected serially between the output terminal and the high-potential power supply; and a fifth MOS transistor of a first conductivity type having a source connected to the output terminal, a gate connected in common with the gate of said fourth MOS transistor, and a drain connected to the low-potential power supply via a fifth switch; and said second buffer circuit comprises:

a second differential stage having:

a second differential pair comprising sixth and seventh MOS transistors of the first conductivity type;

an active load circuit connected between an output pair of said differential pair and the low-potential power supply;

a fifth current source for driving said second differential pair; and a sixth switch for controlling the opening and closing of a current path between said fifth current source and the high-potential power supply;

an eighth MOS transistor, to which one output of said second differential pair is input, having an output connected to the output terminal; the input terminal and the output terminal being connected to gates of respective ones of said sixth and seventh MOS transistors;

a sixth current source and a seventh switch connected serially between the input terminal and the low-potential power supply;

a ninth MOS transistor of a second conductivity type having a source connected to the input terminal and a gate and drain connected to each other, a seventh current source and an eighth switch connected serially between the drain of said ninth MOS transistor and the high-potential power supply;

an eighth current source and a ninth switch connected serially between the output terminal and the low-potential power supply; and a tenth MOS transistor of a first conductivity type having a source connected to the output terminal, a gate connected in common with the gate of said ninth MOS transistor, and a drain connected to the high-potential power supply via a tenth switch.

45. The driver circuit according to claim 13, wherein said reference voltage generating means includes a plurality of resistors and a switch connected between first and second reference voltages;

a voltage within the drive changeover range, which is defined by overlap between the operating ranges of said first and second buffers, being output from a connection point of said resistors when said switch is ON.

46. A liquid crystal display device, wherein a driver circuit set forth in claim 1 is used to drive a data line.

47. The driver circuit according to claim 13, wherein said first buffer circuit includes:

a source-follower transistor connected between the low-potential power supply and the output terminal;

first gate bias control means, which receives the input signal voltage, for supplying said source-follower transistor with a gate bias voltage; and means for precharging the output terminal.

48. The driver circuit according to claim 13, wherein said second buffer circuit includes:

a source-follower transistor connected between the high-potential power supply and the output terminal;

second gate bias control means, which receives the input signal voltage, for supplying said source-follower transistor with a gate bias voltage; and means for pre-discharging the output terminal.

49. The driver circuit according to claim 13, wherein said first buffer circuit includes:

a source-follower first transistor connected between the low-potential power supply and the output terminal;

first gate bias control means, which receives the input signal voltage, for supplying said source-follower first transistor with a first gate bias voltage; and means for precharging the output terminal; and said second buffer circuit includes:

a source-follower second transistor connected between the high-potential power supply and the output terminal;

second gate bias control means, which receives the input signal voltage, for supplying said source-follower second transistor with a second gate bias voltage; and means for pre-discharging the output terminal.

50. The driver circuit according to claim 13, wherein said first buffer circuit includes:

a first current source and a first switch connected serially between the input terminal and the high-potential power supply;

a first MOS transistor of a first conductivity type having a source connected to the input terminal and a gate and drain connected to each other, a second current source and a second switch connected serially between the output terminal and the low-potential power supply;

a third current source and a third switch connected serially between the drain of said first MOS transistor and the high-potential power supply; and a second MOS transistor of the first conductivity type having a source connected to the output terminal, a gate connected in common with the gate of said first MOS transistor, and a drain connected to the low-potential power supply via a fourth switch;

a fifth switch for controlling charging of the output terminal, said fifth switch being provided between the output terminal and the high-potential power supply.

51. The driver circuit according to claim 13, wherein said second buffer circuit includes:

a fourth current source and a sixth switch connected serially between the input terminal and the low-potential power supply;

a third MOS transistor of a second conductivity type having a source connected to the input terminal and a gate and drain connected to each other;

a fifth current source and a seventh switch connected serially between the drain of said third MOS transistor and the high-potential power supply;

a sixth current source and an eighth switch connected serially between the output terminal and the low-potential power supply; and a fourth MOS transistor of the second conductivity type having a source connected to the output terminal, a gate connected in common with the gate of said third MOS transistor, and a drain connected to the high-potential power supply via a ninth switch;

a tenth switch for controlling discharging of the output terminal, said tenth switch being provided between the output terminal and the low-potential power supply.

52. The driver circuit according to claim 13, wherein said first buffer circuit includes:

a first current source and a first switch connected serially between the input terminal and the high-potential power supply;

a first MOS transistor of a first conductivity type having a source connected to the input terminal and a gate and drain connected to each other;

a second current source and a second switch connected serially between the drain of said first MOS transistor and the low-potential power supply;

a third current source and a third switch connected serially between the output terminal and the high-potential power supply; and a second MOS transistor of the first conductivity type having a source connected to the output terminal, a gate connected in common with the gate of said first MOS transistor, and a drain connected to the low-potential power supply via a fourth switch;

a fifth switch for controlling charging of the output terminal, said fifth switch being provided between the output terminal and the high-potential power supply; and said second buffer circuit includes:

a fourth current source and a sixth switch connected serially between the input terminal and the low-potential power supply;

a third MOS transistor of a second conductivity type having a source connected to the input terminal and a gate and drain connected to each other;

a fifth current source and a seventh switch connected serially between the drain of said third MOS transistor and the high-potential power supply;

a sixth current source and an eighth switch connected serially between the output terminal and the low-potential power supply; and a fourth MOS transistor of the second conductivity type having a source connected to the output terminal, a gate connected in common with the gate of said third MOS transistor, and a drain connected to the high-potential power supply via a ninth switch;

a tenth switch for controlling discharging of the output terminal, said tenth switch being provided between the output terminal and the low-potential power supply.

53. The driver circuit according to claim 13, wherein said first buffer circuit includes a voltage follower circuit comprising a differential amplifier circuit which includes a differential pair comprising a pair of MOS transistors of a second conductivity type, said differential amplifier circuit including a non-inverting input terminal to which the input terminal is connected and an inverting input terminal to which the output terminal is connected.

54. The driver circuit according to claim 13, wherein said second buffer circuit includes a voltage follower circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected.

55. The driver circuit according to claim 13, wherein said first buffer circuit includes a first voltage follower circuit comprising a differential amplifier circuit which includes a differential pair comprising a pair of MOS transistors of a second conductivity type, said differential amplifier circuit including a non-inverting input terminal to which the input terminal is connected and an inverting input terminal to which the output terminal is connected; and said second buffer circuit includes a second voltage follower circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected.

56. The driver circuit according to claim 13, wherein said first buffer circuit comprises:

a differential stage having:

a differential pair comprising a pair of MOS transistors of a second conductivity type;

a load circuit connected between an output pair of said differential pair and the high-potential power supply;

a current source for driving said differential pair; and a first switch for controlling the opening and closing of a current path between said current source and the low-potential power supply;

a MOS transistor, which receives one output of said differential pair, having an output connected to the output terminal; and a current source and a switch connected between the output terminal and the low-potential power supply;

the input terminal and the output terminal being connected to gates of respective ones of the pair of MOS transistors of said differential pair.

57. The driver circuit according to claim 13, wherein said second buffer circuit comprises:

a differential stage having:

a differential pair comprising a pair of MOS transistors of a first conductivity type;

a load circuit connected between an output pair of said differential pair and the low-potential power supply;

a current source for driving said differential pair, and a switch for controlling the opening and closing of a current path between said current source and the high-potential power supply;

a MOS transistor, to which one output of said differential pair is input, having an output connected to the output terminal; and a current source and a switch connected between the output terminal and the high-potential power supply;

the input terminal and the output terminal being respectively connected to gates of the pair of MOS transistors of said differential pair.

58. The driver circuit according to claim 13, wherein said first buffer circuit comprises:

a first differential stage having:

a first differential pair comprising first and second MOS transistors of a second conductivity type;

a first load circuit connected between an output pair of said differential pair and the high-potential power supply;

a first current source for driving said first differential pair; and a first switch for controlling the opening and closing of a current path between said first current source and the low-potential power supply;

a third MOS transistor, to which one output of said first differential pair is input, having an output connected to the output terminal; and a second current source and a second switch connected between the output terminal and the low-potential power supply;

the input terminal and the output terminal being connected to gates of respective ones of the first and second MOS transistors of said first differential pair; and said second buffer circuit comprises:

a second differential stage having:

a second differential pair comprising fourth and fifth MOS transistors of a first conductivity type;

a second load circuit connected between an output pair of said differential pair and the low-potential power supply;

a third current source for driving said second differential pair; and a third switch for controlling the opening and closing of a current path between said third current source and the high-potential power supply;

a sixth MOS transistor, to which one output of said second differential pair is input, having an output connected to the output terminal; and a fourth current source and a fourth switch connected between the output terminal and the high-potential power supply;

the input terminal and the output terminal being connected to gates of respective ones of the fourth and fifth MOS transistors of said second differential pair.

59. The driver circuit according to claim 55, further comprising means for precharging and pre-discharging the output terminal.

60. The driver circuit according to claim 13, wherein said first buffer circuit comprises:

a voltage follower circuit comprising a differential amplifier circuit which includes a differential pair comprising a pair of MOS transistors of a second conductivity type, said differential amplifier circuit including a non-inverting input terminal to which the input terminal is connected and an inverting input terminal to which the output terminal is connected;

a source-follower transistor connected to the low-potential power supply and the output terminal; and first gate-bias control means, to which the input signal voltage is input, for supplying said source-follower transistor with a gate bias voltage.

61. The driver circuit according to claim 13, wherein said second buffer circuit comprises:

a voltage follower circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected;

a source-follower transistor connected to the high-potential power supply and the output terminal; and second gate-bias control means, to which the input signal voltage is input, for supplying said source-follower transistor with a gate bias voltage.

62. The driver circuit according to claim 13, wherein said first buffer circuit comprises:

a first voltage follower circuit comprising a differential amplifier circuit which includes a differential pair comprising a pair of MOS transistors of a second conductivity type, said differential amplifier circuit including a non-inverting input terminal to which the input terminal is connected and an inverting input terminal to which the output terminal is connected;

a source-follower first transistor connected to the low-potential power supply and the output terminal; and first gate-bias control means, to which the input signal voltage is input, for supplying said source-follower first transistor with a gate bias voltage; and said second buffer circuit comprises:

a second voltage follower circuit comprising a differential amplifier circuit which includes a differential pair comprising a pair of MOS transistors of a first conductivity type, said differential amplifier circuit including a non-inverting input terminal to which the input terminal is connected and an inverting input terminal to which the output terminal is connected;

a source-follower second transistor connected to the high-potential power supply and the output terminal; and second gate-bias control means, to which the input signal voltage is input, for supplying said source-follower transistor with a gate bias voltage.

63. The driver circuit according to claim 13, wherein said first buffer circuit comprises:

a differential stage having:

a differential pair comprising first and second MOS transistors of a second conductivity type;

an active load circuit connected between an output pair of said differential pair and the high-potential power supply;

a first current source for driving said differential pair; and a first switch for controlling the opening and closing of a current path between said first current source and the low-potential power supply;

a third MOS transistor, to which one output of said differential pair is input, having an output connected to the output terminal; the input terminal and the output terminal being connected to gates of respective ones of said first and second MOS transistors;

a second current source and a second switch connected serially between the input terminal and the high-potential power supply;

a fourth MOS transistor of a first conductivity type having a source connected to the input terminal and a gate and drain connected to each other;

a third current source and a third switch connected serially between the drain of said fourth MOS transistor and the low-potential power supply;

a fourth current source and a fourth switch connected serially between the output terminal and the high-potential power supply; and a fifth MOS transistor of a first conductivity type having a source connected to the output terminal, a gate connected in common with the gate of said fourth MOS transistor, and a drain connected to the low-potential power supply via a fifth switch.

64. The driver circuit according to claim 13, wherein said second buffer circuit comprises:

a differential stage having:

a differential pair comprising sixth and seventh MOS transistors of a first conductivity type;

an active load circuit connected between an output pair of said differential pair and the low-potential power supply;

a fifth current source for driving said differential pair; and a sixth switch for controlling the opening and closing of a current path between said fifth current source and the high-potential power supply;

an eighth MOS transistor, to which an output of said differential pair is input, having an output connected to the output terminal; the input terminal and the output terminal being connected to gates of respective ones of said sixth and seventh MOS transistors;

a sixth current source and a seventh switch connected serially between the input terminal and the low-potential power supply;

a ninth MOS transistor of a second conductivity type having a source connected to the input terminal and a gate and drain connected to each other;

a seventh current source and an eighth switch connected serially between the drain of said ninth MOS transistor and the high-potential power supply;

an eighth current source and a ninth switch connected serially between the output terminal and the low-potential power supply; and a tenth MOS transistor of a first conductivity type having a source connected to the output terminal, a gate connected in common with the gate of said ninth MOS transistor, and a drain connected to the high-potential power supply via a tenth switch.

65. The driver circuit according to claim 13, wherein said first buffer circuit comprises:

a first differential stage having:

a first differential pair comprising first and second MOS transistors of a second conductivity type;

an active load circuit connected between an output pair of said differential pair and the high-potential power supply;

a first current source for driving said differential pair; and a first switch for controlling the opening and closing of a current path between said first current source and the low-potential power supply;

a third MOS transistor, to which one output of said first differential pair is input, having an output connected to the output terminal; the input terminal and the output terminal being connected to gates of respective ones of said first and second MOS transistors;

a second current source and a second switch connected serially between the input terminal and the high-potential power supply;

a fourth MOS transistor of a first conductivity type having a source connected to the input terminal and a gate and drain connected to each other;

a third current source and a third switch connected serially between the drain of said fourth MOS transistor and the low-potential power supply;

a fourth current source and a fourth switch connected serially between the output terminal and the high-potential power supply; and a fifth MOS transistor of a first conductivity type having a source connected to the output terminal, a gate connected in common with the gate of said fourth MOS transistor, and a drain connected to the low-potential power supply via a fifth switch; and said second buffer circuit comprises:

a second differential stage having:

a second differential pair comprising sixth and seventh MOS transistors of the first conductivity type;

an active load circuit connected between an output pair of said differential pair and the low-potential power supply;

a fifth current source for driving said second differential pair; and a sixth switch for controlling the opening and closing of a current path between said fifth current source and the high-potential power supply;

an eighth MOS transistor, to which one output of said second differential pair is input, having an output connected to the output terminal; the input terminal and the output terminal being connected to gates of respective ones of said sixth and seventh MOS transistors;

a sixth current source and a seventh switch connected serially between the input terminal and the low-potential power supply;

a ninth MOS transistor of a second conductivity type having a source connected to the input terminal and a gate and drain connected to each other;

a seventh current source and an eighth switch connected serially between the drain of said ninth MOS transistor and the high-potential power supply;

an eighth current source and a ninth switch connected serially between the output terminal and the low-potential power supply; and a tenth MOS transistor of a first conductivity type having a source connected to the output terminal, a gate connected in common with the gate of said ninth MOS transistor, and a drain connected to the high-potential power supply via a tenth switch.

66. A liquid crystal display device, wherein a driver circuit set forth in claim 13 is used to drive a data line.

* * * * *